US011457684B2

(12) United States Patent
Maloney

(10) Patent No.: US 11,457,684 B2
(45) Date of Patent: Oct. 4, 2022

(54) HELMET HARNESS

(71) Applicant: Brad W. Maloney, Lake Wylie, SC (US)

(72) Inventor: Brad W. Maloney, Lake Wylie, SC (US)

( * ) Notice: Subject to any disclaimer, the term of this patent is extended or adjusted under 35 U.S.C. 154(b) by 247 days.

(21) Appl. No.: 16/791,690

(22) Filed: Feb. 14, 2020

(65) Prior Publication Data

US 2020/0253315 A1 Aug. 13, 2020

Related U.S. Application Data

(63) Continuation-in-part of application No. 15/530,343, filed on Dec. 27, 2016, now Pat. No. 10,588,374.

(60) Provisional application No. 62/387,472, filed on Dec. 24, 2015, provisional application No. 62/389,055, filed on Feb. 16, 2016.

(51) Int. Cl.
*A42B 3/14* (2006.01)

(52) U.S. Cl.
CPC ..... *A42B 3/142* (2013.01); *A42B 3/145* (2013.01)

(58) Field of Classification Search
CPC ..... A42B 3/142; A42B 3/145; A42B 3/00; A42B 3/0406; A42B 3/06; A42B 3/0493; A42B 3/067; A42B 3/062; A42B 3/10; A42B 3/065; A42B 3/066; A42B 3/16; A42B 3/124
USPC ..... 2/421
See application file for complete search history.

(56) References Cited

U.S. PATENT DOCUMENTS 2,239,946 A * 4/1941 Upchurch, Jr. ..... A42B 3/28 2/413
3,991,423 A 11/1976 Jones
3,994,020 A * 11/1976 Villari ..... A42B 3/122 2/413
5,572,749 A 11/1996 Ogden
5,790,988 A * 8/1998 Guadagnino, Jr. ..... A42B 3/00 2/411
5,983,405 A 11/1999 Casale
7,328,462 B1 * 2/2008 Straus ..... A42B 3/067 2/411
7,516,914 B2 4/2009 Kovacevich et al.
(Continued)

OTHER PUBLICATIONS

Matthew Futterman, Rethinking the Next-Generation Helmet, The Wall Street Journal, Dec. 24, 2015, Dow Jones & Company, Inc., a division of News Corp., New York, NY.

*Primary Examiner* — Alissa J Tompkins
*Assistant Examiner* — Catherine M Ferreira
(74) *Attorney, Agent, or Firm* — The Van Winkle Law Firm; William G. Heedy

(57) ABSTRACT

A helmet harness (3200) has an outer shell (3205) and an inner shell (3210) held moveably together by a grommet (3215). The outer shell has an outer frame (3220) and a plurality of pads (3225) for protection and comfort. The inner shell has an inner frame (3250) and a plurality of pads (3255) for protection and comfort. The outer frame and the inner frame have a plurality of longitudinal and lateral ribs (3235, 3265). The ribs form a plurality of holes of voids (3237, 3267) which reduce weight and provide for ventilation. The pads cover at least a portion of the inside surfaces of the outer frame and the inner frame. The grommet allows the outer shell and the inner shell to pitch, roll, and yaw with respect to each other, but not to so freely move as to be distracting and undesirable to the user.

9 Claims, 35 Drawing Sheets

(56) References Cited

U.S. PATENT DOCUMENTS

| | | | | |
|---|---|---|---|---|
| 8,032,993 | B2 | 10/2011 | Musal | |
| 8,578,520 | B2 | 11/2013 | Halidin | |
| 8,640,267 | B1 * | 2/2014 | Cohen | A42B 3/063 2/411 |
| 8,955,169 | B2 * | 2/2015 | Weber | A42B 3/064 2/411 |
| 8,959,723 | B2 | 2/2015 | Gennrich et al. | |
| 9,021,616 | B2 | 5/2015 | Baty | |
| 9,066,551 | B2 | 6/2015 | Van Waes | |
| 9,179,729 | B2 | 11/2015 | Cotterman et al. | |
| 9,386,818 | B2 * | 7/2016 | Rensink | A42B 3/08 |
| 10,842,216 | B2 * | 11/2020 | Ganly | A42B 3/127 |
| 2009/0210998 | A1 * | 8/2009 | Rolla | A42B 3/14 2/411 |
| 2011/0072548 | A1 * | 3/2011 | Hersick | A42B 3/22 2/5 |
| 2013/0205477 | A1 * | 8/2013 | Pfanner | A42B 3/14 2/416 |
| 2013/0305435 | A1 * | 11/2013 | Surabhi | A42B 3/06 2/414 |
| 2014/0259572 | A1 | 9/2014 | Maloney | |
| 2015/0059063 | A1 * | 3/2015 | Ho | A42C 2/002 2/411 |
| 2017/0273390 | A1 | 9/2017 | Maloney | |

* cited by examiner

HELMET HARNESS

RELATED APPLICATION

This application is a Continuation-in-Part Application of U.S. Non-Provisional patent application Ser. No. 15/530,343 filed on Dec. 27, 2016, which claims priority to and incorporates entirely by reference U.S. Provisional Patent Application Ser. No. 62/387,472 filed on Dec. 24, 2015, and U.S. Provisional Patent Application Ser. No. 62/389,055 filed on Feb. 16, 2016.

BACKGROUND

This disclosure relates to a helmet harness for use with a wearable article, such as a helmet.

SUMMARY OF THE INVENTION

A helmet harness affords freedom of movement with respect to yaw, roll, and pitch (i.e., six degrees of freedom) between an outer frame of a helmet harness and an inner frame of the helmet harness.

DETAILED DESCRIPTION OF EXAMPLES OF THE INVENTION

Figure 1:
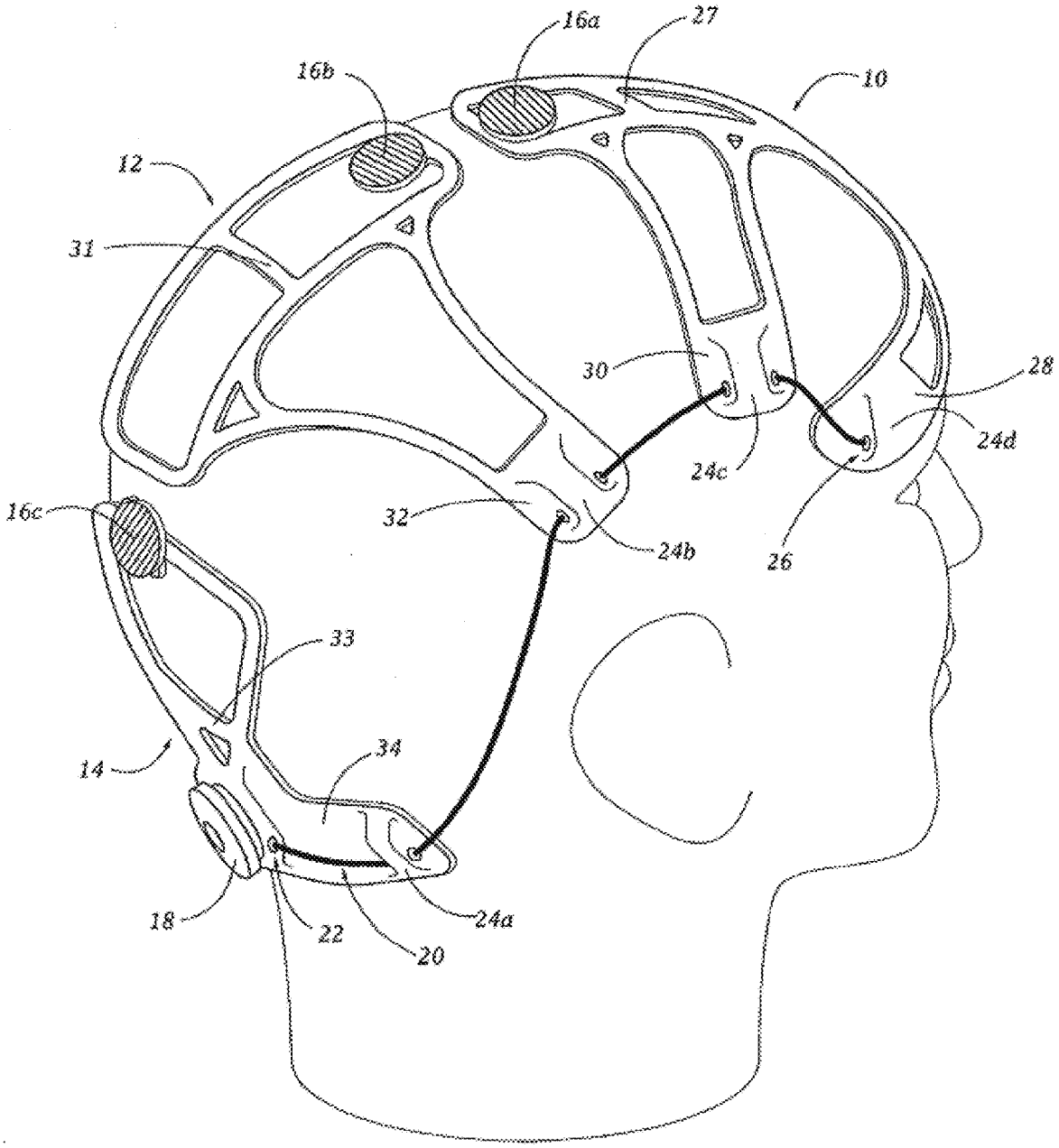
FIG. 1 is a perspective view of an example of a helmet harness system according to the invention.

FIG. 1 is a perspective view of a helmet harness system according to one example of the invention. The parts of the system shown in FIG. 1 are symmetrical along a longitudinal axis extending along the top of the harness system, between the front of the system and the back of the system. The system comprises a front support member indicated generally at 10, a central support member indicated generally at 12, and a rear yoke support member indicated generally at 14. The support members 10, 12, and 14 are spaced apart from each other. The support members 10, 12, and 14 are provided with attachment members 16*a*, 16*b*, and 16*c*, respectively, for securing the support members to the inside of a helmet shell (not shown in FIG. 1), for example, or to corresponding attachment members (not shown) provided on the inside of a helmet, or other wearable articles. At least one attachment member is provided for each of the support members 10, 12, and 14. Additional attachment members may be used, if desired. The attachment member 16*a* is located at the rear of the front support member 10. The attachment member 16*b* is located at the front of the central support member 12. The attachment member 16*c* is located at the front, or top, of the rear yoke support member 14.

The attachment members may comprise snap basket connectors, inverse clip connectors (such as those shown and described in my US patent application published on Sep. 18, 2014 under publication no. US 2014/0259572, the disclosure of which is expressly incorporated herein by reference), buckle connectors, fabric connectors, hook and loop connectors, elastic connectors, or any combination of these or other connectors.

A dial lace tightening mechanism 18 is provided on the rear yoke support member 14. The ends of a lace or the ends of laces 20 are received in the dial lace tightening mechanism 18. There are several types of dial lace tightening mechanisms which are suitable for use in the harness system of the present invention. Some of these mechanisms are shown and described in U.S. Pat. No. 9,179,729, the entire disclosure of which is expressly incorporated herein by reference. The dial lace tightening mechanism 18 can be operated manually to increase or decrease the tension in the lace(s) 20, as by rotating a knob on the mechanism. Such a mechanism may include a spool on which a lace is wound and unwound, as desired.

In the example shown in FIG. 1, a lace 20 extends from a lace portal 22 in the dial lace tightening mechanism 18, on the right side of the dial lace tightening mechanism 18. As noted above, the system shown in FIG. 1 may be symmetrical in which case there would be a corresponding lace (not shown) extending from a lace portal (not shown) on the left side of the dial lace tightening mechanism 18. Hereinafter, the right side of the helmet harness system will be described with the understanding that corresponding parts may be provided on the left side of the helmet harness system.

The lace 20 extends out of the lace portal 22 and extends through a sliding lace guide 24*a* on the rear yoke support member 14, through a sliding lace guide 24*b* on the central support member 12, and through a sliding lace guide 24*c* on the front support member. The end of the lace 20 that is opposite the end of the lace that extends from the dial lace tightening mechanism 18 extends through a lace terminal portal 26 into a terminal lace connection 24*d* on the front support member 10. This end of the lace is fixed within the terminal lace connection 24*d*.

The front support member 10 has a central longitudinally extending web 27. The attachment member 16 *a* is supported on this central web 27. A front support member front right wing 28 extends downwardly from the central web 27 with the terminal lace connection 24*d* positioned at the terminus of the wing 28. A front support member rear right wing 30 extends downwardly from the central web 27 with the sliding lace guide 24*c* at the terminus of the wing 30. The wing 28 is spaced from the wing 30.

The central support member 12 has a central longitudinally extending web 31. The attachment member 16*b* is supported on this central web 31. A central support member right wing 32 extends downwardly from the central web 31 with the sliding lace guide 24*b* positioned at the terminus of the wing 32.

The rear yoke support member 14 has a central longitudinally extending web 33. The attachment member 16*c* is supported on this central web 33. A rear yoke support member right wing 34 extends downwardly from the central web 33 with the sliding lace guide 24*a* positioned at the terminus of the wing 34.

Tightening the lace 20, as by manipulating the dial lace tightening mechanism 18, draws the terminus of the front support member front right wing back towards the rear yoke support member 14. Tension in the lace 20 serves to pull the front support member rear right wing 30 downwardly around the wearer's head and inwardly against the wearer's head. Tension in the lace 20 also serves to pull the central support member right wing 32 downwardly, around the wearer's head, and inwardly against the wearer's head. An individual can dial in a custom fit by manipulating the dial lace tightening mechanism 18 to provide the desired amount of compression in the helmet harness system. The tension of the lace, and corresponding compression provided by the system can be adjusted on the fly to accommodate changing conditions.

Figure 2:
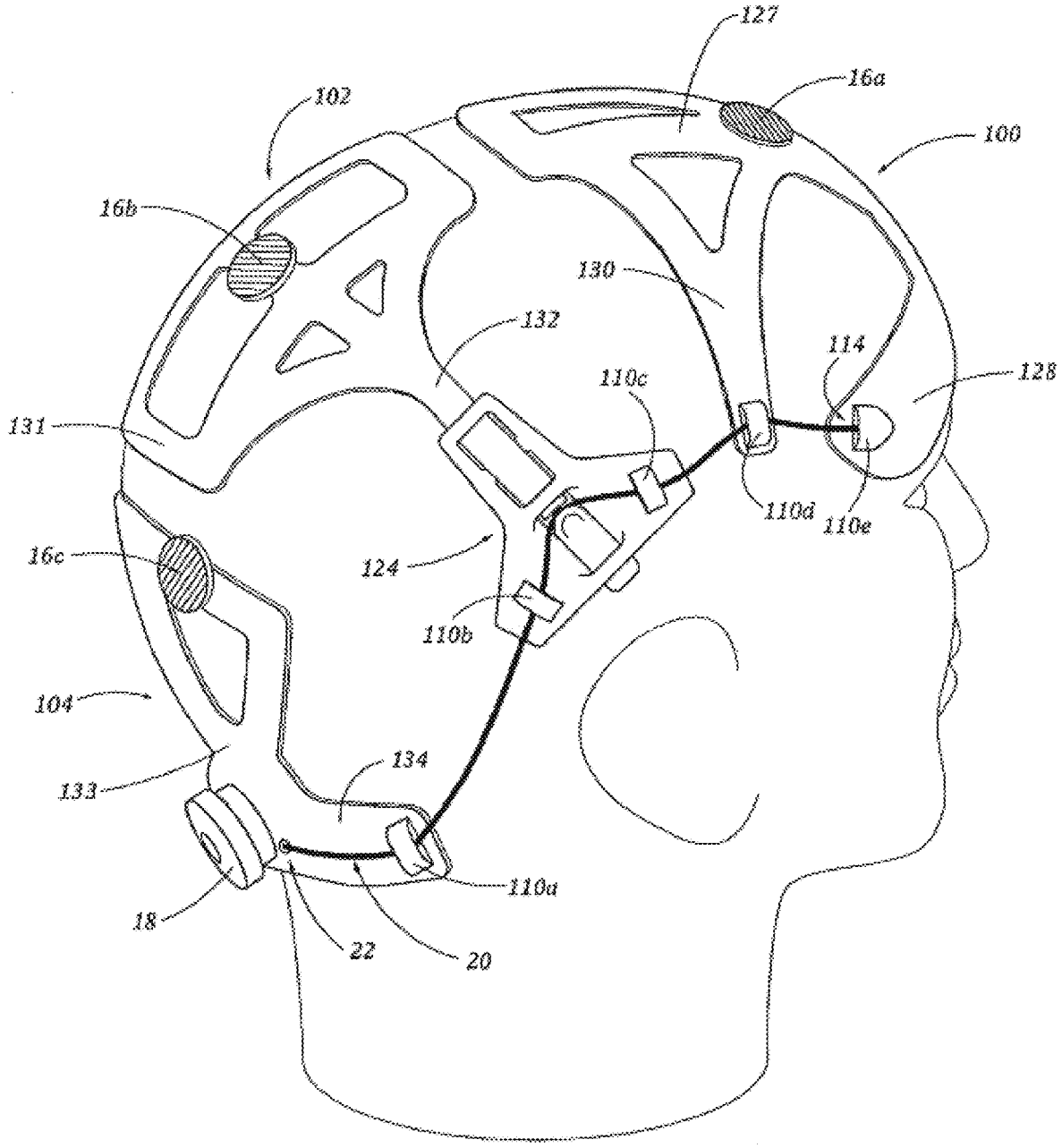
FIG. 2 is a perspective view of another example of a helmet harness system according to the invention.

FIG. 2 is a perspective view of a helmet harness system according to another example of the invention. The parts of the system shown in FIG. 2 may also be symmetrical along a longitudinal axis extending between the front of the system and the back of the system. The system comprises a front support member indicated generally at 100, a central support member indicated generally at 102, and a rear yoke support member indicated generally at 104. The support members 100, 102, and 104 are separate and spaced apart from each other. The support members 100, 102, and 104 are provided with attachment members 16*a*, 16*b*, and 16*c*, respectively, for securing the helmet harness system to the inside of a helmet (not shown), for example, or to corresponding attachment members (not shown) provided on the inside of a helmet. At least one attachment member is provided for each of the support members 100, 102, and 104. Additional attachment members may be used, if desired. Fewer attachment members may be used. The attachment member 16*a* is located in the center (front to back) of the front support member 100. The attachment member 16*b* is located in the center (front to back) of the central support member 102. The attachment member 16*c* is located at the front, or top, of the rear yoke support member 104.

The FIG. 2 example embodiment includes the dial lace tightening mechanism 18 provided on the rear yoke support member 104. The ends of a lace 20, or the ends of laces 20, are received in the dial lace tightening mechanism 18. In this case, the lace 20 extends from a lace portal 22 on the right side of the dial lace tightening mechanism 18. The system shown in FIG. 2 may also be symmetrical so there would be a corresponding lace (not shown) extending from a lace portal (not shown) on the left side of the dial lace tightening mechanism 18. Hereinafter, the right side of the helmet harness system of FIG. 2 will be described with the understanding that corresponding parts may be provided on the left side of the helmet harness system.

The lace 20 extends out of the lace portal 22 and extends through a sliding lace guide 110*a* on the rear yoke support member 104, through sliding lace guides 110*b* and 110*c* associated with the central support member 102, and through a sliding lace guide 110*d* on the front support member 100. The end of the lace 20 that is opposite the end of the lace that is received in the dial lace tightening mechanism 18 extends through a lace terminal portal 114 into a terminal lace connection 110*e* on the front support member 100. The sliding lace guides 110*b* and 110*c* are carried on a guide support 124 which is described in more detail below, with reference to FIGS. 6, 7, and 8.

The front support member 100 has a central longitudinally extending web 127. The attachment member 16*a* is supported on this central web 127. A front support member front right wing 128 extends downwardly from the central web 127 with the terminal lace connection 110*e* positioned at the terminus of the wing 128. A front support member rear right wing 130 extends downwardly from the central web 127 with the sliding lace guide 110*d* at the terminus of the wing 130. The wing 128 is spaced from the wing 130.

The central support member 102 has a central longitudinally extending web 131. The attachment member 16*b* is supported on this central web 31. A central support member right wing 132 extends downwardly from the central web 131. The right wing is slidingly supported in the guide support 124 which carries the sliding lace guides 110*b* and 110*c* and is positioned at the terminus of the wing 132.

The rear yoke support member 104 has a central longitudinally extending web 133. The attachment member 16*c* is supported on this central web 33. A rear yoke support member right wing 134 extends downwardly from the central web 133 with the sliding lace guide 110*a* positioned at the terminus of the wing 134.

Tightening the lace 20, as by manipulating the dial lace tightening mechanism 18, draws the terminus of the front support member front right wing 128 back towards the rear yoke support member 104. Tension in the lace 20 serves to pull the front support member rear right wing 130 downwardly around the wearer's head and inwardly against the wearer's head. Tension in the lace 20, acting through the sliding lace guides 110*b* and 110*c* carried on the guide support, also serves to pull the central support member right wing 132 downwardly, around the wearer's head, and inwardly against the wearer's head.

Figure 3:
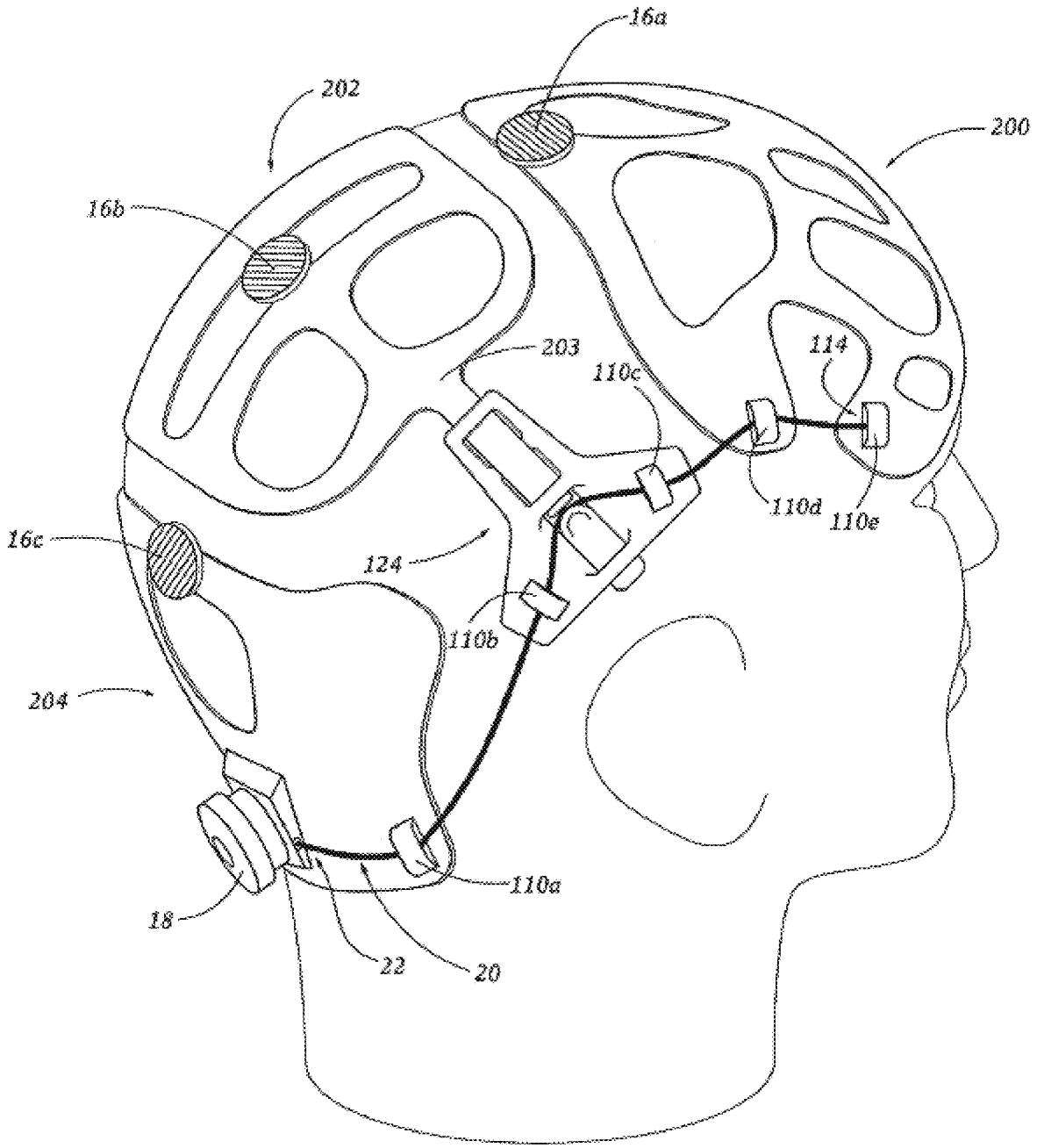
FIG. 3 is a perspective view of another example of a helmet harness system according to the invention.

FIG. 3 is a perspective view of a helmet harness system according to another example of the invention. The parts of the system shown in FIG. 3 may also be symmetrical along a longitudinal axis extending between the front of the system and the back of the system. The FIG. 3 system corresponds generally with the FIG. 2 system. A front support member indicated generally at 200 in FIG. 3 has more surface area than the corresponding front support member 100 shown in FIG. 2, and the right wings on the front support member 200 are wider and shorter than the corresponding wings shown in FIG. 2. A central support member indicated generally at 202 in FIG. 3 has more surface area than the corresponding central support member 102 shown in FIG. 2. The rear yoke support member indicated generally at 204 in FIG. 3 has more surface area than the corresponding rear yoke support member 104 shown in FIG. 2. This configuration can be advantageous in that forces that arise from tension in the lace(s) 20 may be distributed over a larger area.

The support members 200, 202, and 204 are separate and spaced apart from each other. The support members 200, 202, and 204 are provided with attachment members 16*a*, 16*b*, and 16*c*, respectively, for securing the support members to the inside of a helmet (not shown), for example, or to corresponding attachment members (not shown) provided on the inside of a helmet. At least one attachment member is provided for each of the support members 200, 202, and 204. Additional attachment members, or fewer attachment members may be used, if desired. The attachment member 16*a* is located in the rear (front to back) of the front support member 200. The attachment member 16*b* is located in the center (front to back) of the central support member 202. The attachment member 16*c* is located at the front, or top, of the rear yoke support member 204.

A central support member right wing 203 extends downwardly from the central support member 202. The right wing 203 is slidingly supported in a guide support 124 which carries the sliding lace guides 110*b* and 110*c*, and is positioned at the terminus of the wing 203.

Figure 4:
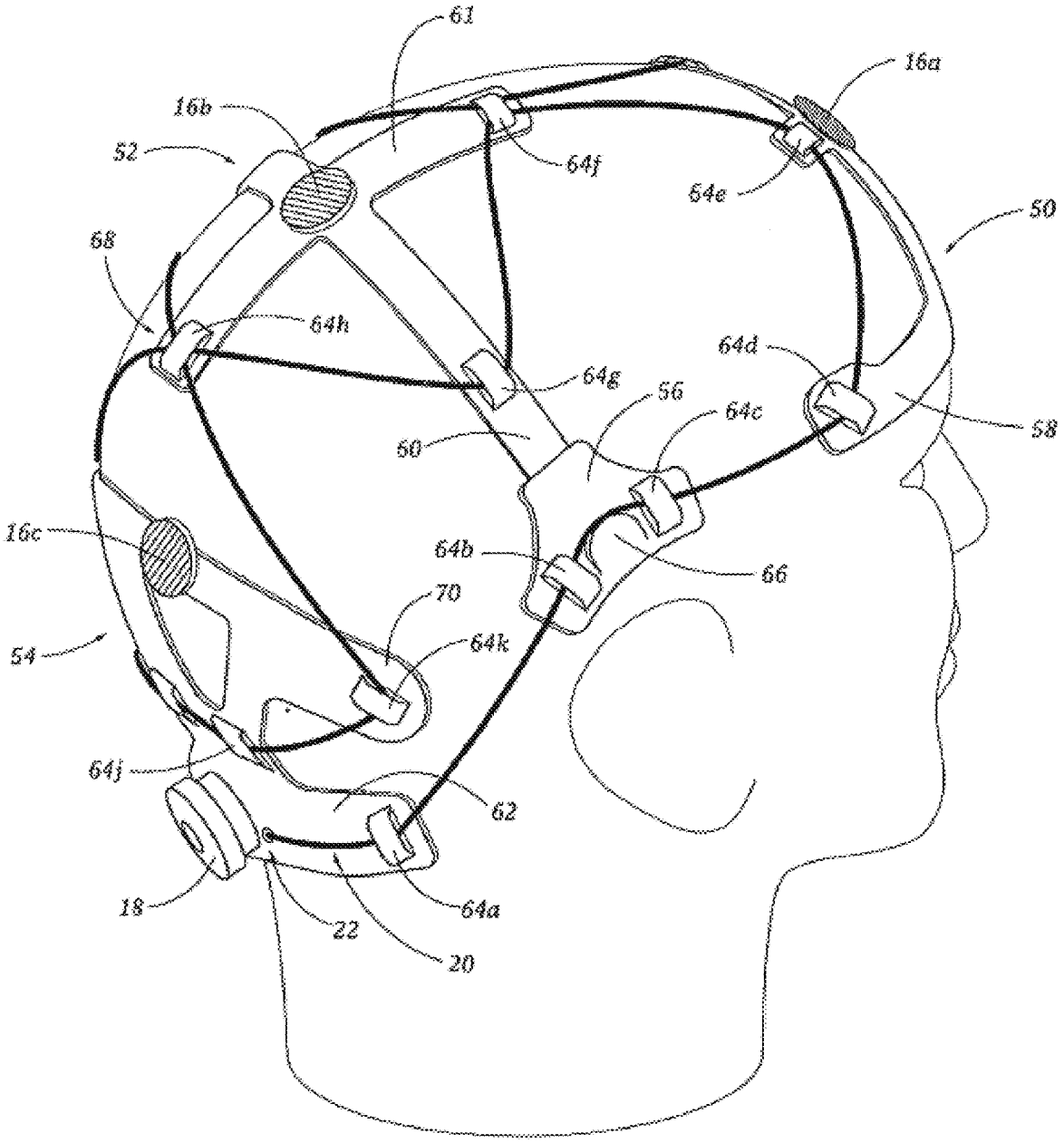
FIG. 4 is a perspective view of another example of a helmet harness system according to the invention.

FIG. 4 is a perspective view of a helmet harness system according to another example of the invention. The parts of the system shown in FIG. 4 may also be symmetrical along a longitudinal axis extending between the front of the system and the back of the system. The system comprises a front support member indicated generally at 50, a central support member indicated generally at 52, and a rear yoke support member indicated generally at 54. The support members 50, 52, and 54 are separate and spaced apart from each other. The support members 50, 52, and 54 are provided with attachment members 16*a*, 16*b*, and 16*c*, respectively, for securing the support members to the inside of a helmet (not shown), for example, or to corresponding attachment members (not shown) provided on the inside of a helmet or other wearable article. At least one attachment member is provided for each of the support members 50, 52, and 54. Additional attachment members, or fewer attachment members may be used, if desired. The attachment member 16*a* is located in the rear (front to back) of the front support member 50. The attachment member 16*b* is located in the center (front to back) of the central support member 52. The attachment member 16*c* is located at the front, or top, of the rear yoke support member 54.

The FIG. 4 example embodiment includes the dial lace tightening mechanism 18 provided on the rear yoke support member 54. In this case, a single lace 20 extends from a lace portal 22 on the right side of the dial lace tightening mechanism 18, through a circuitously arranged plurality of sliding lace guides and back into a lace portal (left lace portal 22, not shown) on the left side of the dial lace tightening system 18. The system shown in FIG. 4 may also be symmetrical.

The front support member 50 constitutes a forehead strap having a front support member right wing 58 with lower right and upper right sliding lace guides 64*d* and 64*e*. In the case where the system is generally symmetrical, a front support member left wing (left wing 58, not shown) is provided with lower left and upper left sliding lace guides (left lace guide 64*d* and left lace guide 64*e*, not shown).

The central support member 52 has a central support member right wing 60 with a sliding lace guide 64*g* and a guide support 56 at the end, with sliding lace guides 64*b* and 64*c*, and a lace shoulder 66. In the case where the system is generally symmetrical, a central support member left wing (left wing 60, not shown) is provided with a left sliding lace guide (left lace guide 64*g*, not shown) and a left guide support 56 (left guide support 56, not shown) at the end, with left sliding lace guides (left sliding lace guides 64*b* and 64*c*, not shown) a left lace shoulder (left lace shoulder 66, not shown). The central support member 52 has a longitudinally extending wing 61 with a dual sliding lace guide 64*f* at the front, and a rear, crossover, sliding lace guide 64*h*.

The rear yoke support member 54 has an upper rear yoke support member right wing 70, with a sliding lace guide 64*k*, and a lower rear yoke support member right wing 62, with a sliding lace guide 64*a*. In the case where the system is generally symmetrical, the rear yoke support member 54 has an upper rear yoke support member left wing (left wing 70, not shown) with a sliding lace guide 64*k* (left sliding lace guide 64*k*, not shown), and a lower rear yoke support member left wing (left wing 62, not shown) with a sliding lace guide 64*a* (left sliding lace guide 64 *a*, not shown). The rear yoke support member 54 includes a sliding lace guide 64*j* on the right side and a corresponding lace guide on the left (left sliding lace guide 64*j*, not shown).

The lace pattern in the helmet harness system shown in FIG. 4 may be described as follows. The lace exits the right side lace portal 22 on the dial lace tightening mechanism and extends, in the following order, through:

Sliding lace guide 64*a;*
Sliding lace guide 64*b;*
Sliding lace guide 64*c;*
Sliding lace guide 64*d;*
Sliding lace guide 64*e;*
Dual sliding lace guide 64*f;*
Sliding lace guide 64*g;*
Rear, crossover, sliding lace guide 64*h;*
Left sliding lace guide 64*k;*
Left sliding lace guide 64*j;*
Sliding lace guide 64*j;*
Sliding lace guide 64*k;*
Rear, crossover, sliding lace guide 64*h;*
Left sliding lace guide 64*g;*
Dual sliding lace guide 64*f;*
Left sliding lace guide 64*e;*
Left sliding lace guide 64*d;*
Left sliding lace guide 64*c;*
Left sliding lace guide 64*b;*
Left sliding lace guide 64*a*; and Back into the left side lace portal 22 in the dial lace tightening mechanism 18. With this lacing pattern, the FIG. 4 harness system affords freedom of movement in respect of pitch, yaw and roll, and in respect of movement to the right and left, movement up or down, and movement front and back, all while maintaining the harness system securely supported on one's head. This freedom of movement is referred to herein as six degrees of freedom.

Figure 5:
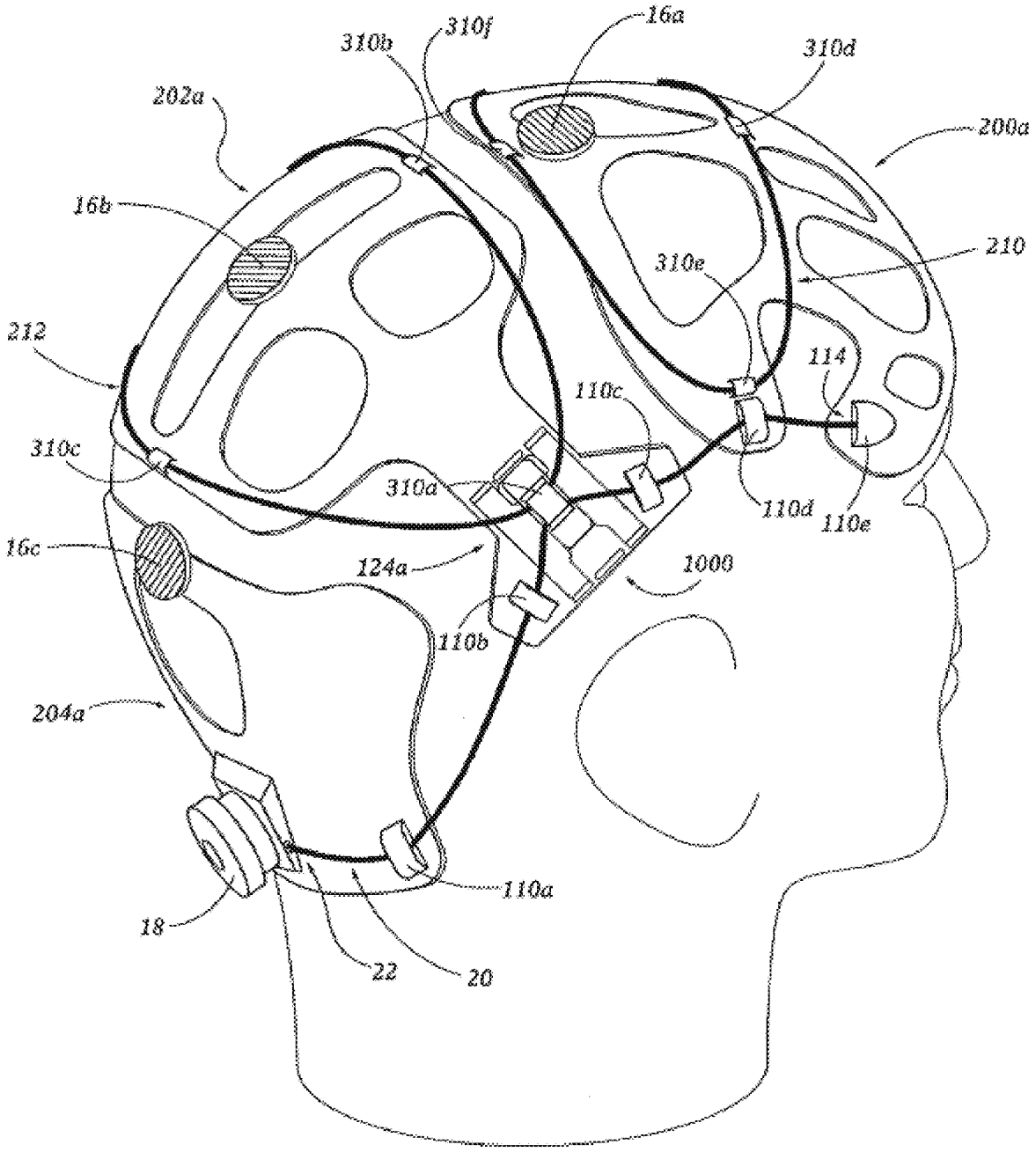
FIG. 5 is a perspective view of another example of a helmet harness system according to the invention.

The helmet harness system shown in FIG. 5 comprises a front support member 200*a*, a central support member 202*a*, and a rear yoke support member 204*a*.

The front support member 200*a* corresponds, generally, with the front support members 100 and 200 shown in FIGS. 2 and 3, and further includes a closed lace loop 210 secured to the front support member 200*a* by a rear lace guide 310*f*, a front lace guide 310*d*, a right lace guide 310*e* and a corresponding left lace guide (left lace guide 310*e*, not shown).

The central support member 202*a* corresponds, generally, with the central support members 102 and 202 shown in FIGS. 2 and 3, and further includes a closed lace loop 212 secured to the central support member 202*a* by a rear lace guide 310*c*, and a front lace guide 310*b*. The right guide support 124*a* and the left guide support (left guide support 124*a*, not shown) correspond generally with the guide supports 124 shown in FIGS. 2 and 3, and they further include right front lace guide 110*c*, a corresponding left front lace guide (left lace guide 110*c*, not shown), a right rear lace guide 110*b*, and a corresponding left rear lace guide (left lace guide 110*b*, not shown). The closed lace loop 212 is further secured to the central support member 202*a* by the right lace guide 310*a* on the guide support 124*a*, and a left lace guide 310*a*.

Figure 6:
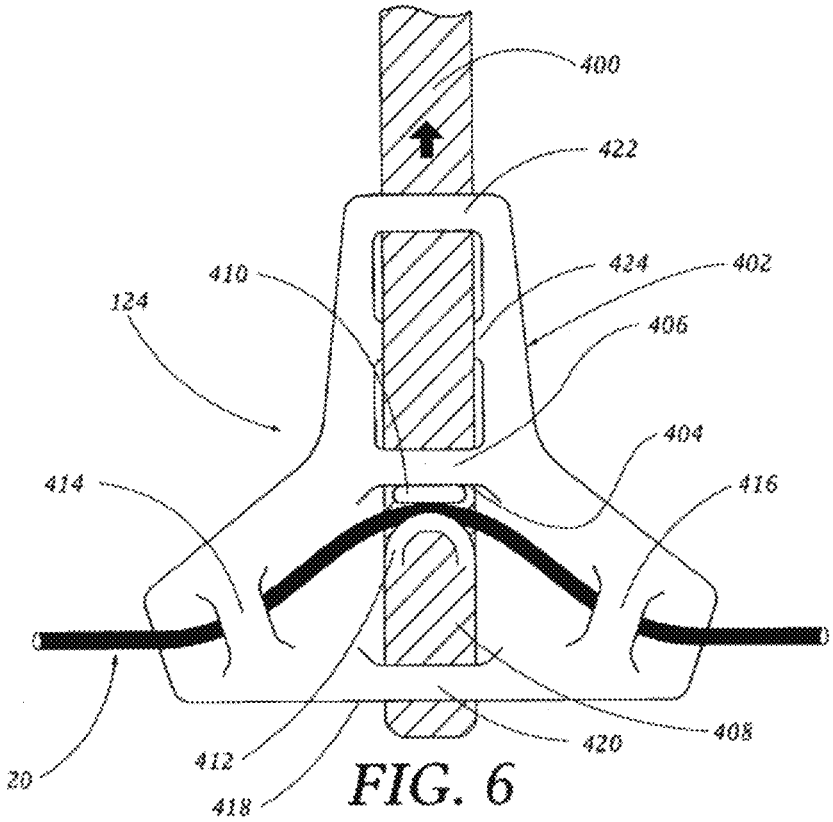
FIG. 6 is a plan view of an example of a guide support with a dynamic tension adjustment feature suitable for use with a helmet harness system according to the invention.
Figure 7:
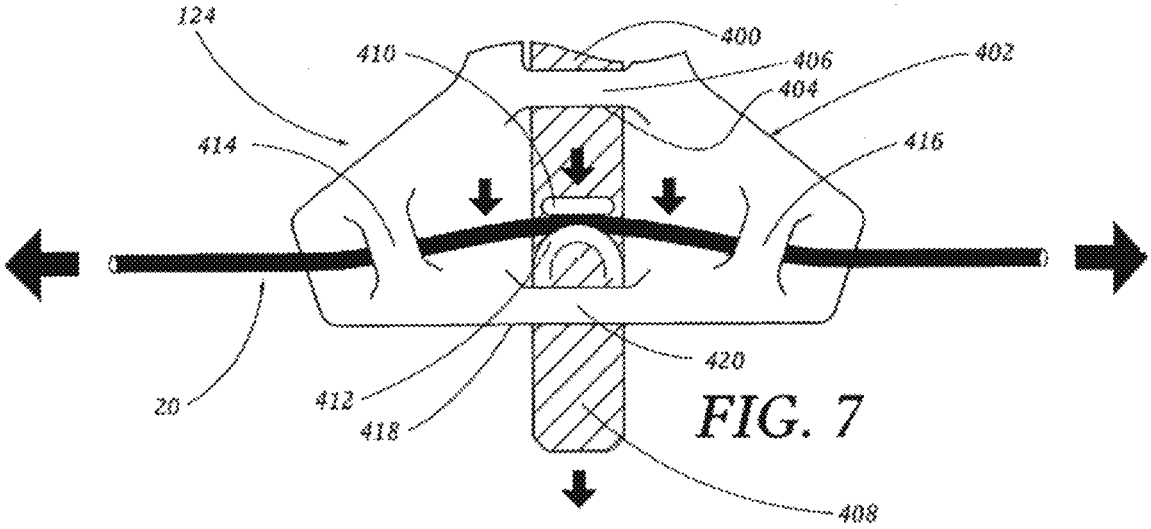
FIG. 7 is a plan view of a portion of the guide support shown in FIG. 6.
Figure 8:
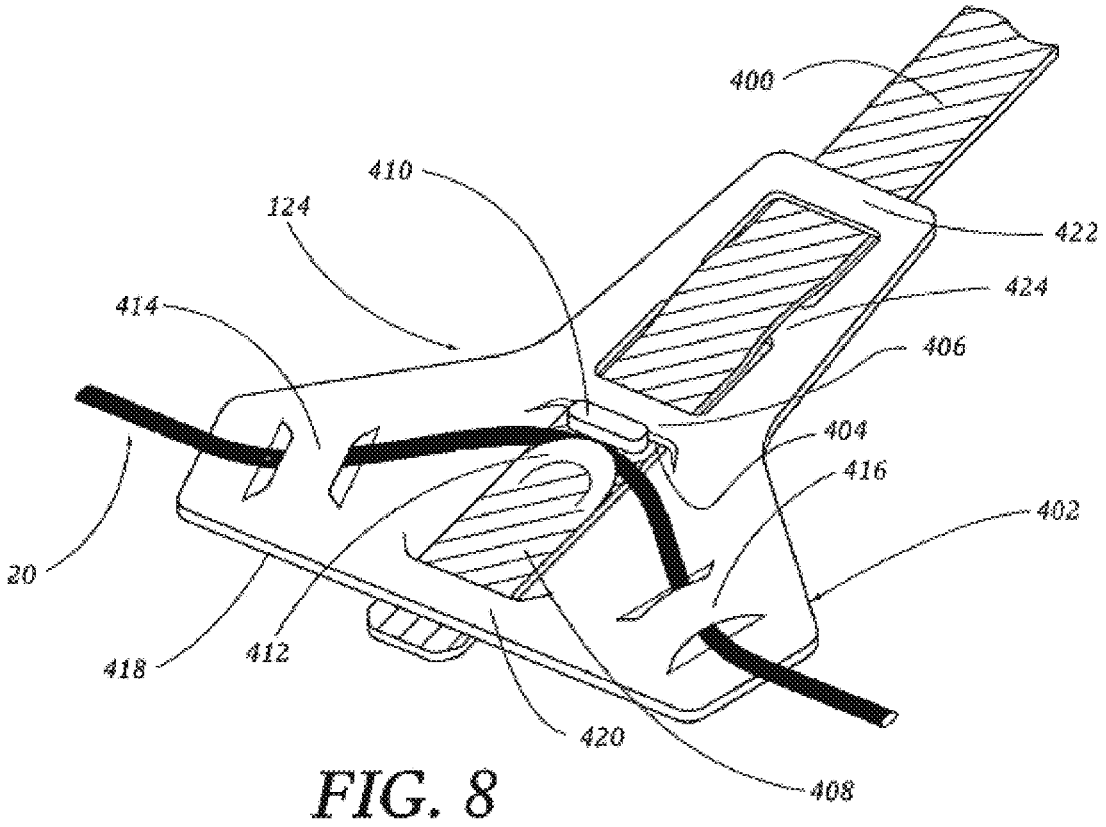
FIG. 8 is a perspective view of the guide support shown in FIG. 6.

The lace guide support 124 shown in FIGS. 2 and 3 is shown in more detail in FIGS. 6, 7 and 8. In FIGS. 2 and 3, the lace guide support 124 cooperates with the strap 132 and 203, which are connected to or integral with the central support members 102 and 202, respectively. Lace guide support 124*a* is shown in FIG. 5 and is connected to or integral with central support member 202*a*. The lace guide supports 124 and 124*a* can be used in cooperation with any support member, such as a front support member or a rear yoke support member. Lace guide support 124*a* is shown in more detail in FIGS. 13 through 15.

With reference to FIGS. 6 through 8, the lace guide support 124 is a dynamic lace connector and it comprises a buckle 402 which is operable to receive, for example, a strap 400. Specifically, there is an opening indicated at 404 through which the strap 400 can pass. The opening 404 is defined between a first bridge 406 and a portion (not shown) of the buckle 402 that is spaced from the first bridge 406. In the example shown in FIGS. 6 through 8, the portion of the buckle 402 that cooperates with the first bridge 406 to define the opening 404 is below a lower portion 408 of the strap 400. On portion 408 of the strap 400, there is a first sliding lace guide defined, in the example shown in FIGS. 6 through 8, by a first shoulder 410 and a second shoulder 412. The first sliding lace guide between the first and second shoulders 410 and 412 permits sliding movement of the lace 20 in either direction, as indicated by the arrows adjacent to the lace 20 in FIG. 7.

The buckle 402 is provided with a second sliding lace guide 414 and a third sliding lace guide 416. The sliding lace guides 414 and 416 are positioned between the first bridge 406 and a first end 418 of the buckle 402. The sliding lace guides 414 and 416 are spaced from each other with the sliding lace guides 414 and 416 between the first bridge 406 and a second bridge 420. When tension is applied to the strap 400 in the direction of the arrow shown in FIG. 6, the strap 400 is free to move in the direction of the arrow until the shoulder 410 contacts the first bridge 406. When the strap 400 is in the position shown in FIG. 6, and tension is applied to the lace 20 in the direction indicated by the arrows beside the lace ends shown in FIG. 7, the lace 20 acts on the second shoulder 412 creating a tension force which acts on the strap 400 in the direction of the arrows adjacent to the strap in FIG. 7. When tension on the strap 400 in the direction of the arrow in FIG. 6 is greater than the tension on the strap 400 in the opposite direction, the strap 400 will move towards the position shown in FIG. 6 until the first shoulder abuts the bridge 406. When tension on the strap 400 in the direction of the arrows in FIG. 7 is greater than the tension on the strap 400 in the opposite direction, the strap 400 will move towards the position shown in FIG. 7.

When tension on the strap 400 in the direction of the arrows in FIG. 7 is greater than the tension on the strap 400 in the opposite direction, the strap 400 will move towards the position shown in FIG. 7 until the second shoulder 412 abuts the second bridge 420. The buckle 402 may include a third bridge 422 and a fourth bridge 424. With this arrangement, the strap 400 can pass under the second bridge 420, under the first bridge 406, over the third bridge 424, and under the third bridge 422. This arrangement tends to keep the strap 400 and the buckle 402 aligned, especially when the strap 400 is under tension.

Figure 9:
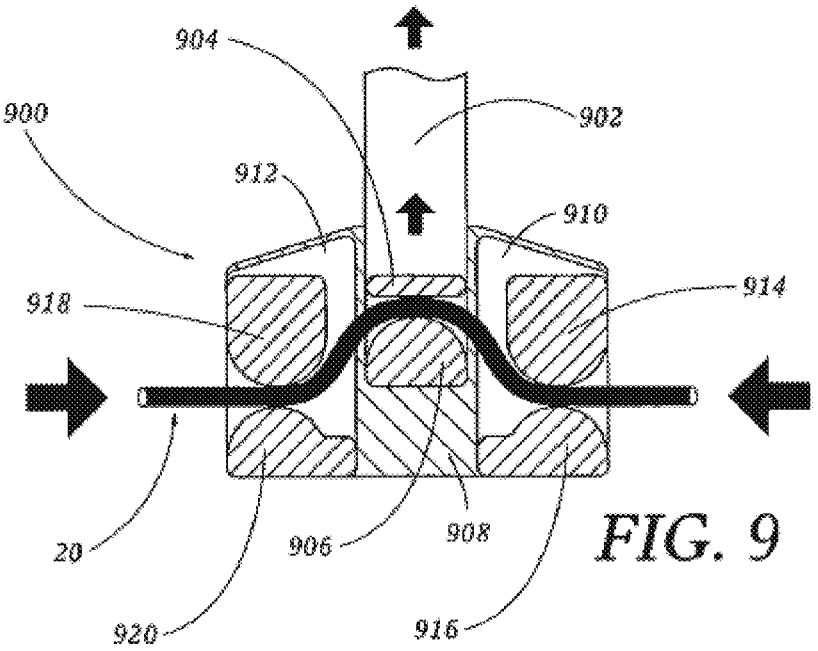
FIG. 9 is a plan view of an example of a portion of a guide support with dynamic tension adjustment suitable for use with a helmet harness system according to the invention.
Figure 10:
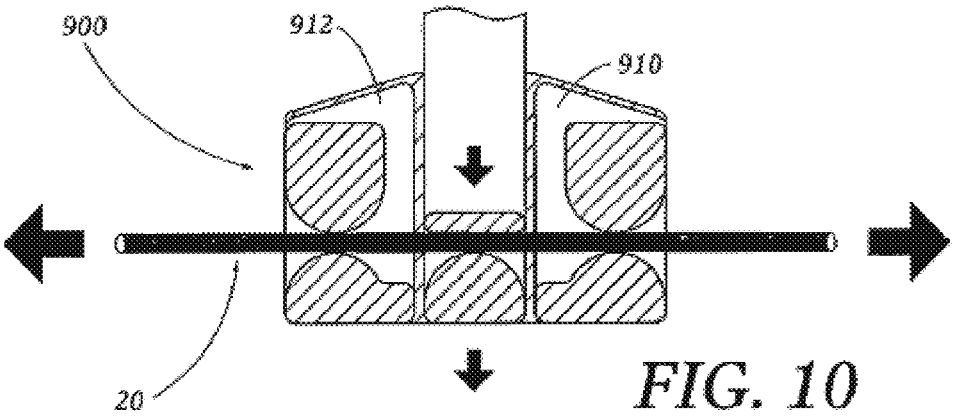
FIG. 10 is a plan view of the guide support shown in FIG. 9.
Figure 12:
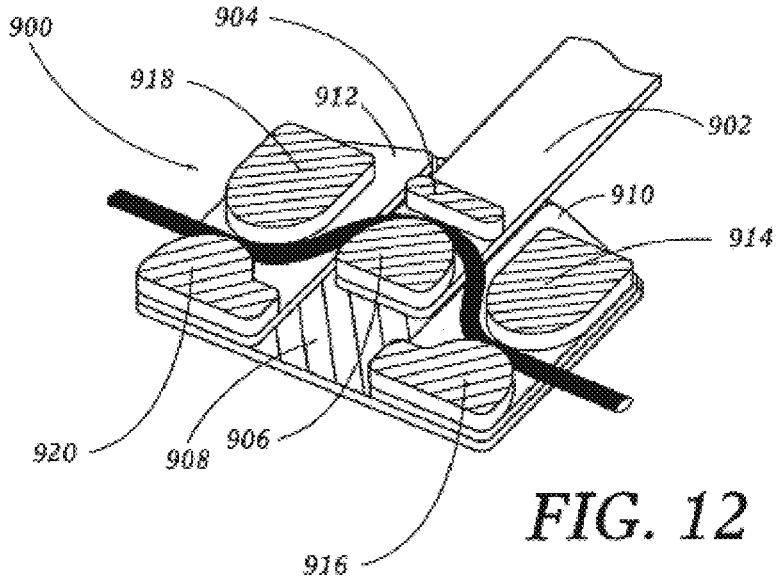
FIG. 12 is a perspective view of the guide support shown in FIG. 9.

Referring now to FIGS. 9, 10 and 12, another dynamic lace connector is indicated generally at 900. A strap 902 is provided with a first sliding lace guide comprising a first strap shoulder 904 and a second strap shoulder 906. The shoulders 904 and 906 are spaced to receive a lace 20 for sliding movement therebetween. The strap 902 slides on a base 908 in a groove between a first ledge 910 and a second ledge 912, each supported on the base 908 in spaced relationship. It is preferred that the height of the ledges 910 and 912 be about the same as the thickness of the strap 902.

Figure 11:
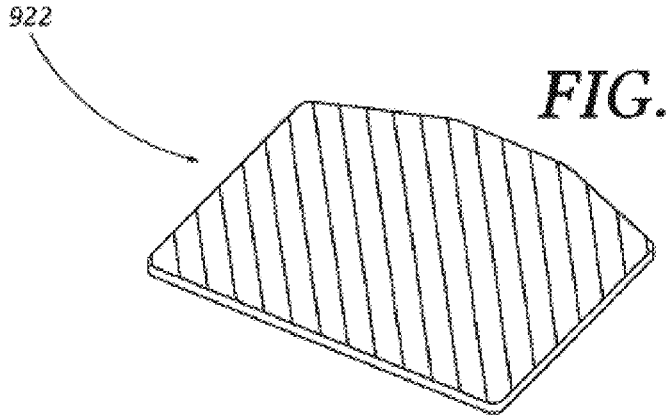
FIG. 11 is a perspective view of a cover suitable for use with the guide support shown in FIG. 9.

The first ledge 910 carries a second sliding lace guide comprising a first lace guide shoulder 914 and a second lace guide shoulder 916. The second ledge 912 carries a third sliding lace guide comprising a first lace guide shoulder 918 and a second lace guide shoulder 920. A cover 922 (FIG. 11) may be provided and secured to the first and second first ledge shoulders 914 and 916, and to the first and second ledge shoulders 918 and 920. With the cover 922 in place, the strap 902 and the lace 20 are held captive between the base 908 and the cover 922.

In FIGS. 9, 10, and 12, the lace 20 is positioned in the first, second, and third sliding lace guides, and the strap 902 is in the groove between the first and second ledges 910 and 912. When the lace 20 and strap 902 are in the positions shown in FIG. 10, and tension is applied to the strap 902 in the direction shown in FIG. 9, the lace 20 is drawn into the connector 900 as indicated by the lace arrows. When the lace 20 is put under tension, as indicated by the lace arrows in FIG. 10, and the tension force is greater than the tension force on the strap 902, the strap 902 will be drawn into the connector 900 towards the position shown in FIG. 10. Whenever the tension force acting directly on the strap 902 is not equal to the tension force applied to the strap 902 by the lace 20, the connector will dynamically adjust the position of the strap within the connector 900 until equilibrium is reached.

Figure 13:
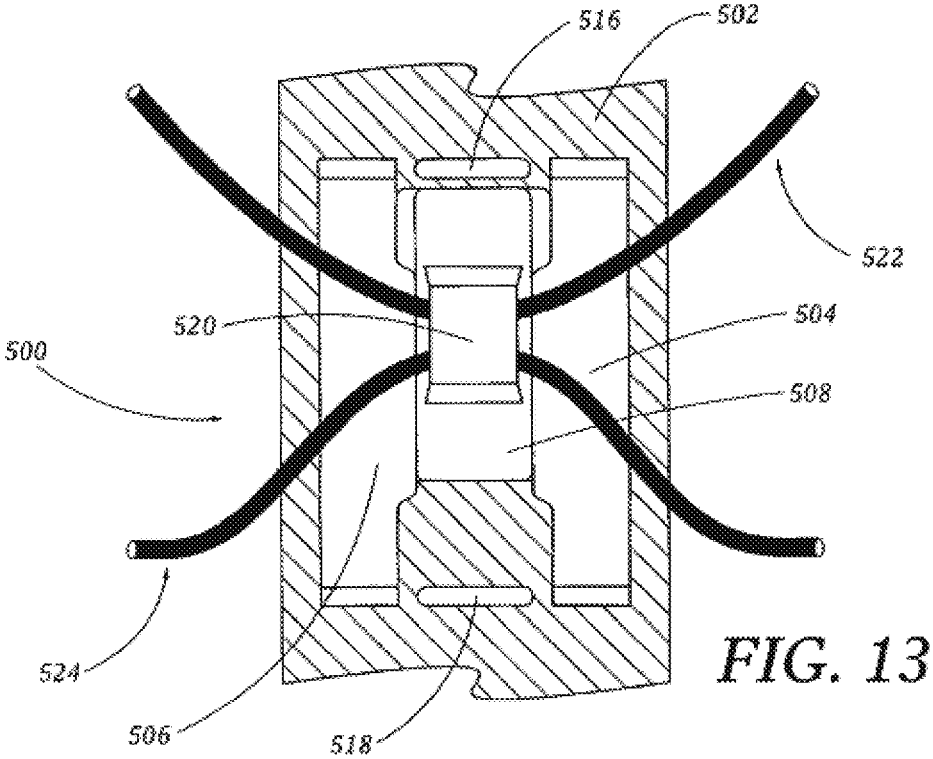
FIG. 13 is a plan view of an example of a guide support with dynamic tension adjustment suitable for use with a helmet harness system according to the invention.
Figure 14:
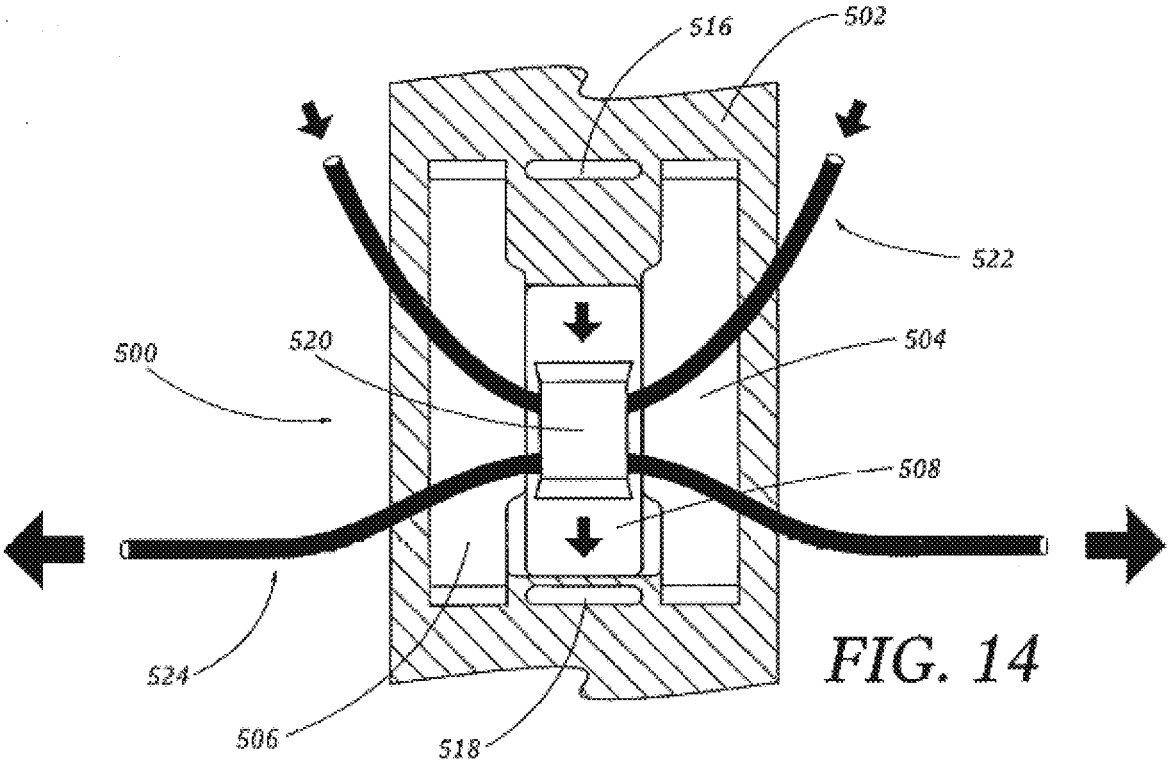
FIG. 14 is a plan view of the guide support shown in FIG. 13.
Figure 15:
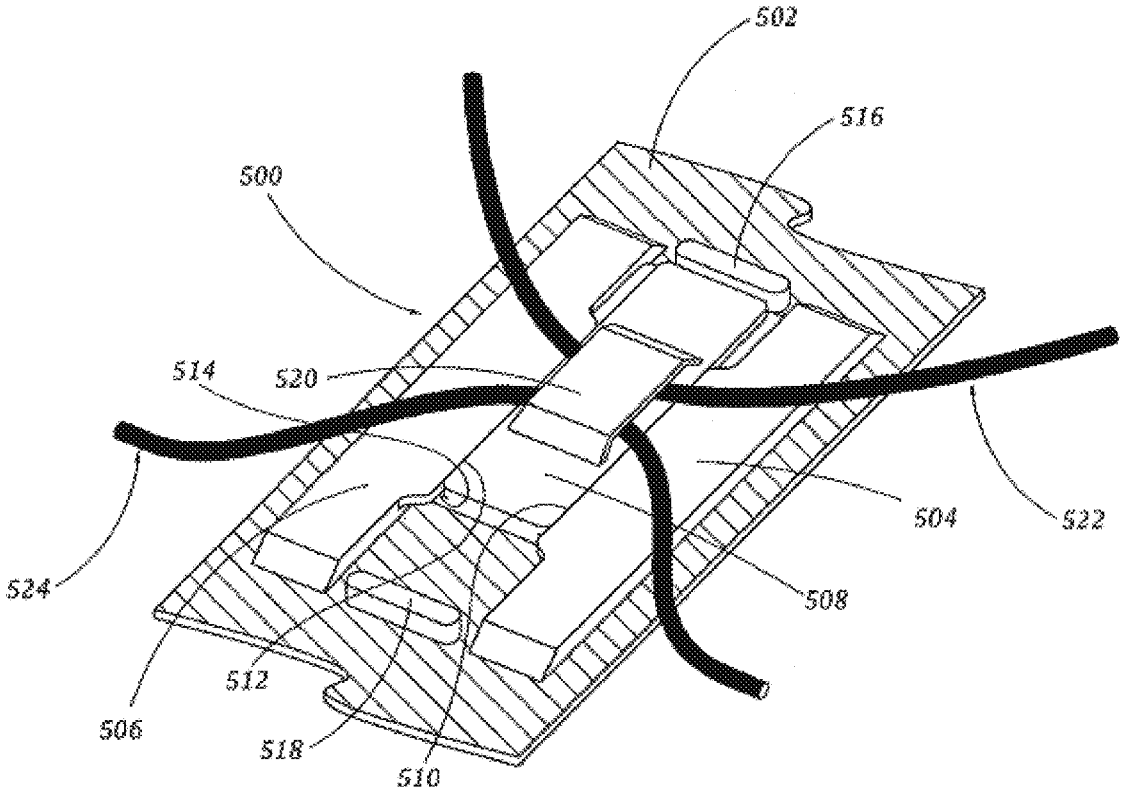
FIG. 15 is a perspective view of the guide support shown in FIG. 13.

In FIGS. 13 through 15, a dynamic lace to lace connector is indicated generally at 500. The connector 500 comprises a base 502 with first and second shoulders 504 and 506 supported on the base 502 in spaced relationship. A slider 508 is positioned between the shoulders 504 and 506 which are provided with ledges 510 and 512, respectively (FIG. 15). The slider 508 has a ridge 514 extending outwardly, adjacent to the base 502, under the ledge 512, and a corresponding ridge (not shown) extending under the ledge 510. Thus, the slider 508 is supported between the shoulders 504 and 506 for reciprocating, longitudinal movement relative to the base 502. First and second stops 516 and 518 limit movement of the slider 508 so that it can slide between the relative position shown in FIGS. 13 and 15, on one hand, and the relative position shown in FIG. 14, on the other hand.

The slider 508 is provided with a dual sliding lace guide 520 in which laces 522 and 524 are supported for sliding movement. The lace 522 loops around towards the stop 516 so that tension in the lace 522 creates tension in the slider 508 tending to move the slider 508 towards the stop 516. The lace 524 loops around towards the stop 518 so that tension in the lace 524 creates tension in the slider 508 tending to move the slider 508 towards the stop 518. As the tension in the laces 522 and 524 varies, the connector 500 dynamically adjusts to move the system towards equilibrium.

Figure 16:
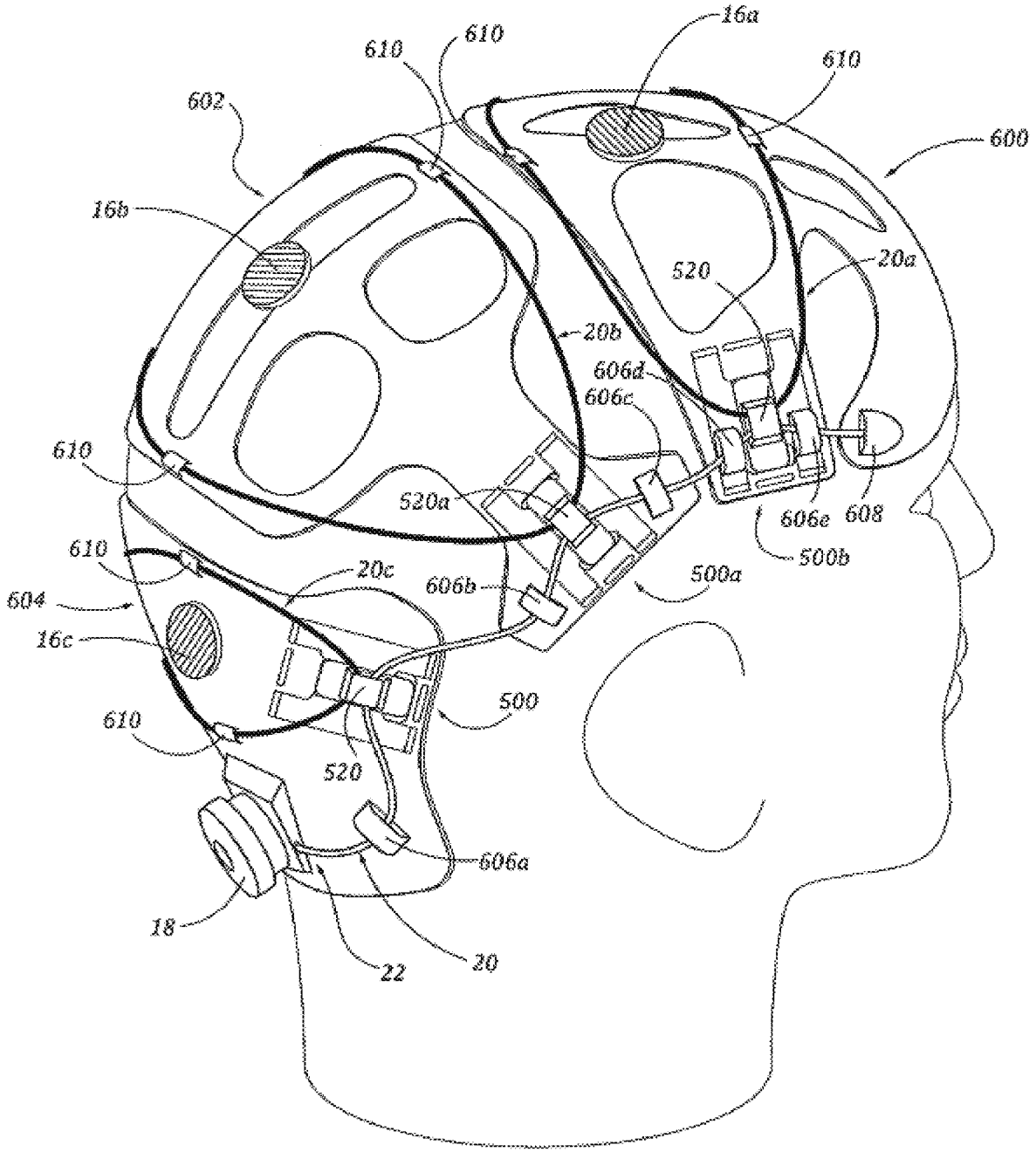
FIG. 16 is a perspective view of an example of a helmet harness system according to the invention.
Figure 17:
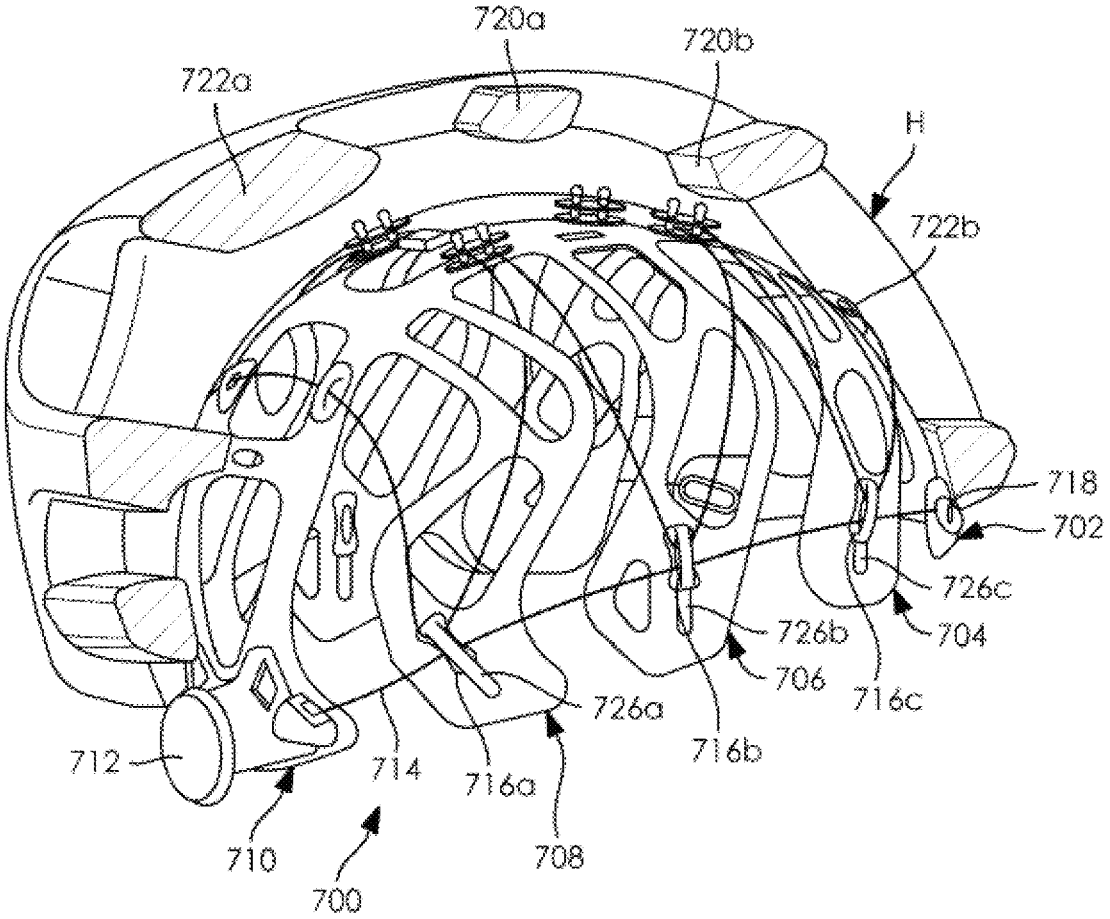
FIG. 17 is a perspective view of an example of a helmet harness system, according to the invention, in a helmet that is partially broken away.
Figure 18:
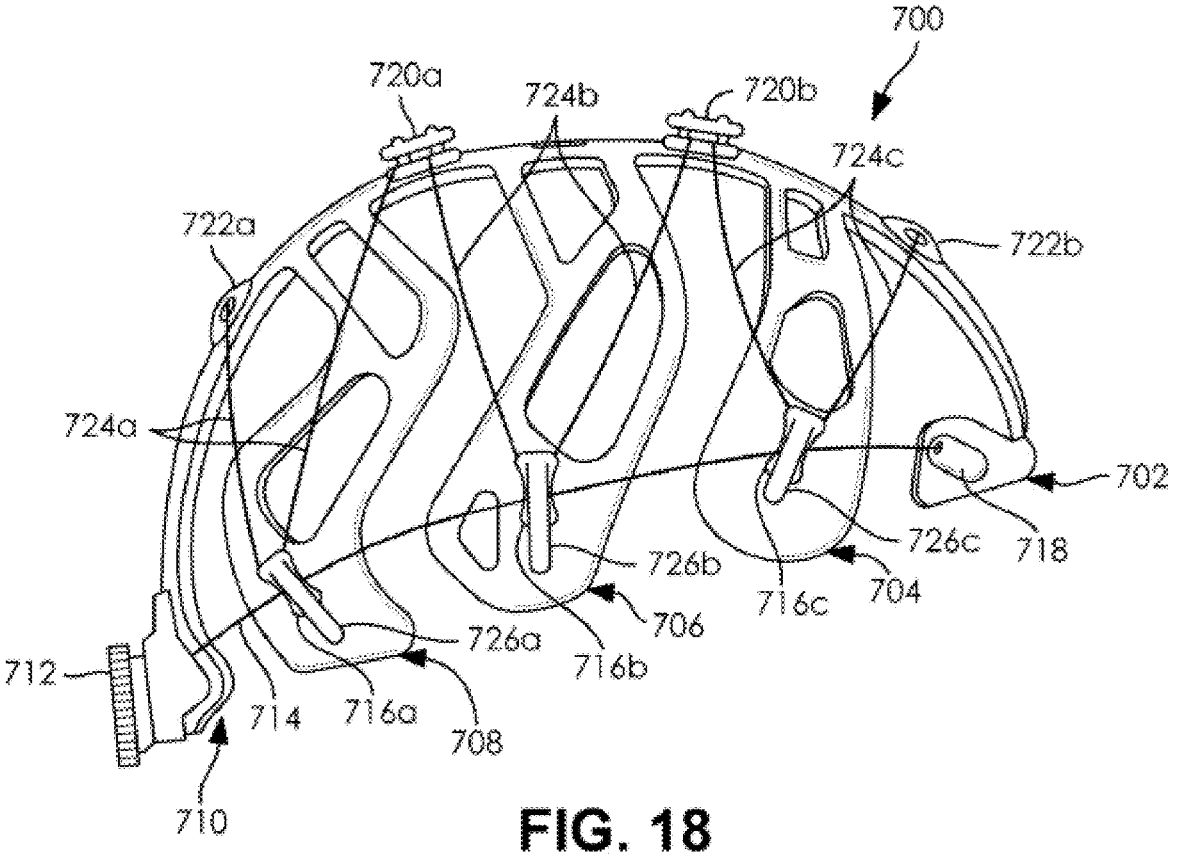
FIG. 18 is a perspective view of the helmet harness system shown in FIG. 17.
Figure 19:
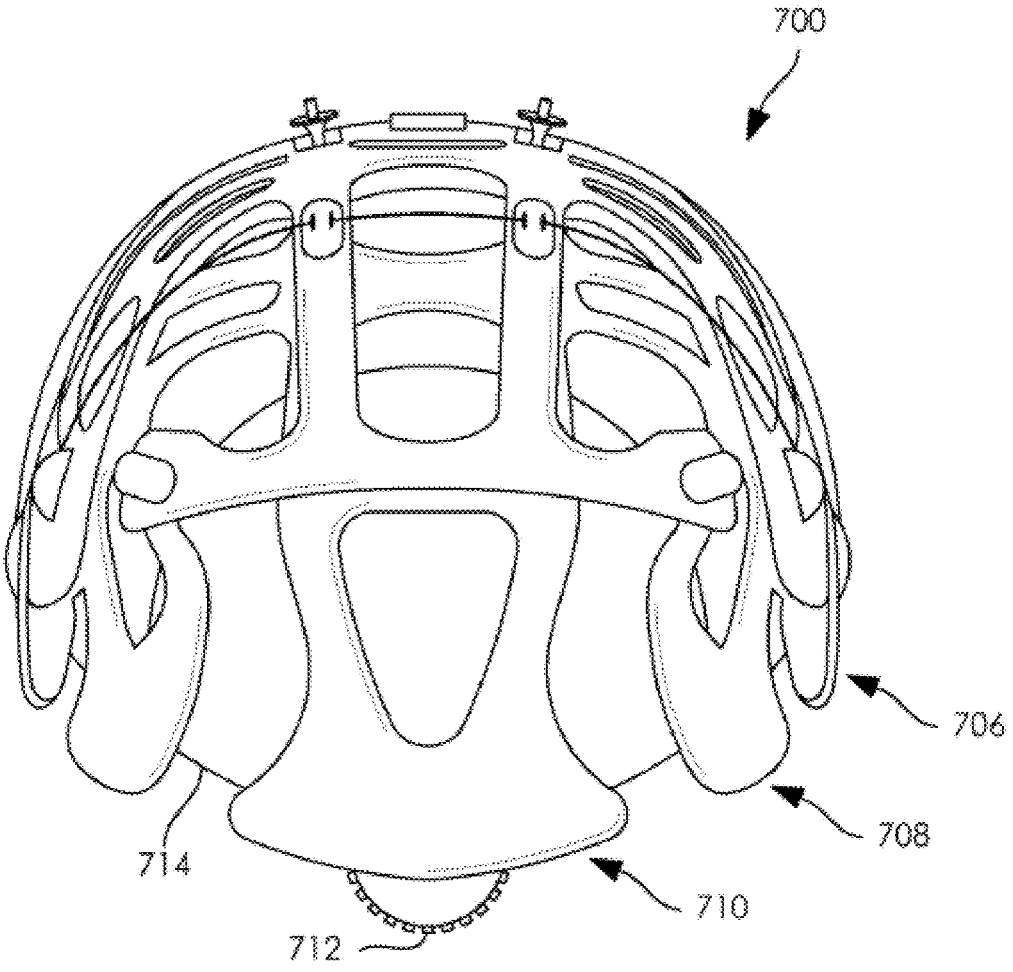
FIG. 19 is a rear view of the helmet harness system shown in FIG. 17.
Figure 20:
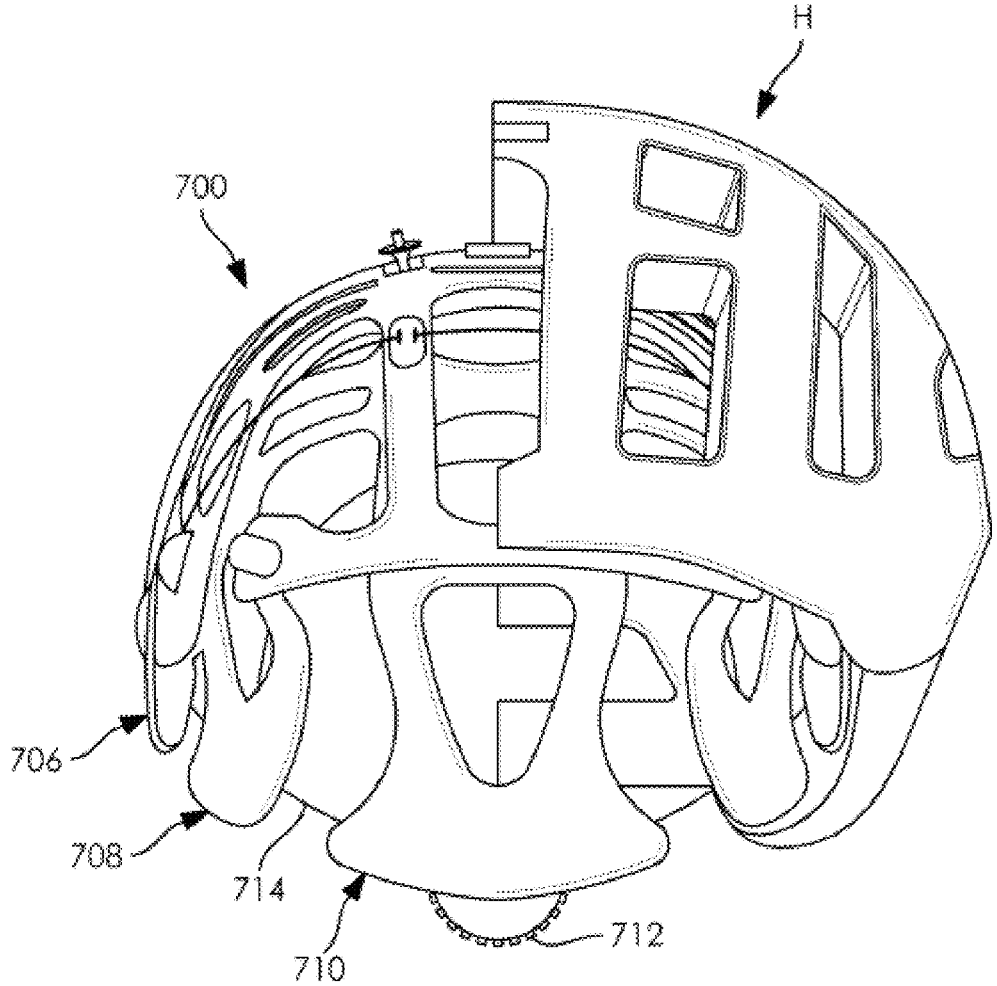
FIG. 20 is a rear view of the helmet harness system shown in FIG. 17 in a helmet that is partially broken away.
Figure 21:
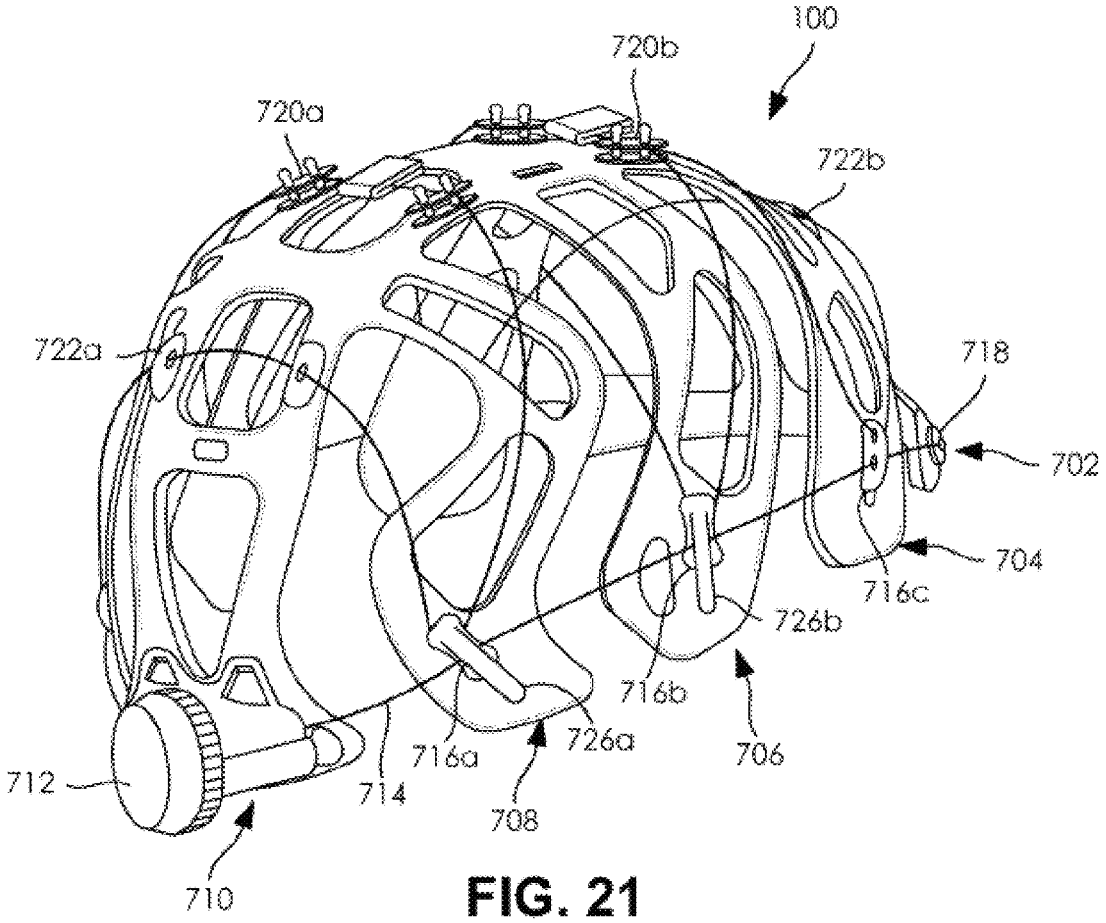
FIG. 21 is a perspective view of the helmet harness system shown in FIG. 17.
Figure 22:
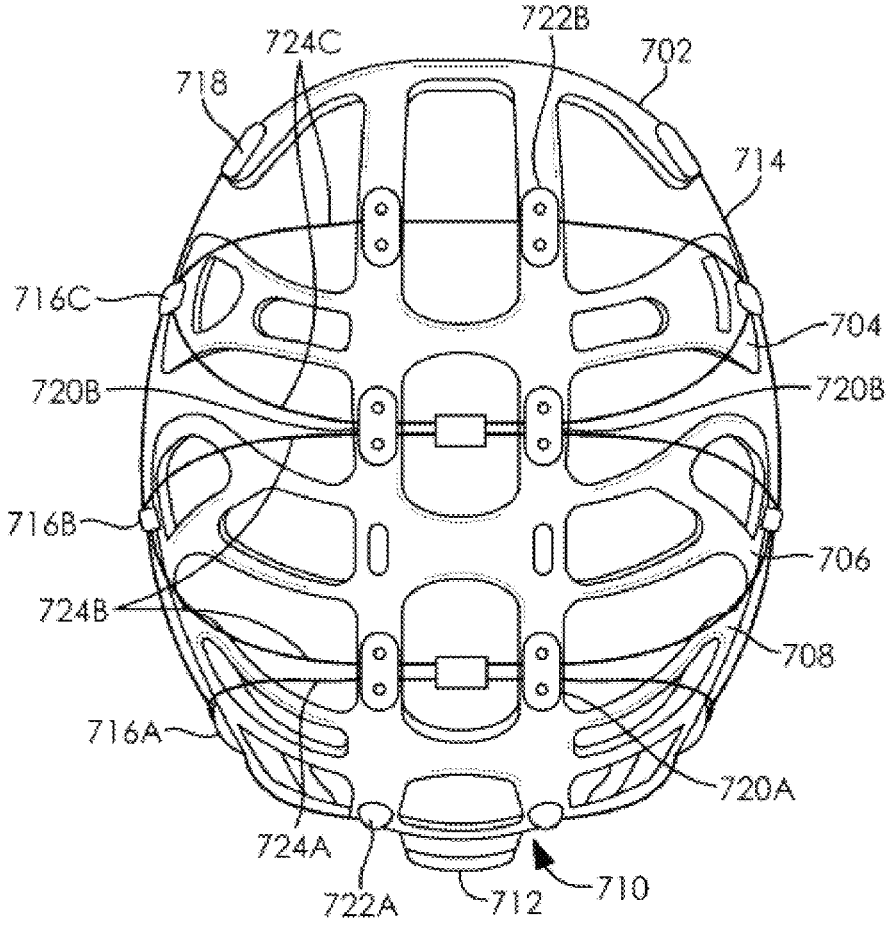
FIG. 22 is a top view of the helmet harness system shown in FIG. 17.

Another example of a helmet harness system according to the invention is shown in FIG. 16. The system comprises a front support member 600, a central support member 602, and a rear yoke support member 604. A lower lace 20 extends from a dial lace tightening system 18 through a plurality of sliding lace guides 606*a*, 606*b*, 606 *c*, 606*d*, and 606*e* and into a terminal lace connection 608 on the front support member 600. A dynamic lace to lace connector 500 is provided on the rear yoke support member 604 and the lace 20 is in the dual sliding lace guide 520 thereon. A closed lace loop 20*c* is supported on the rear yoke support member 604, as by lace guides 610, and the closed lace loop 20*c* is also in the dual sliding lace guide 520. A dynamic lace to lace connector 500*a* is provided on the central support member 602 and the lace 20 passes through the dual sliding lace guide 520 thereon. A closed lace loop 20*b* is supported on the central support member 602, as by lace guides 610, and the closed lace loop 20*b* passes through a dual sliding lace guide 520 on the connector 500*a*. A dynamic lace to lace connector 500*b* is provided on the front support member 600 and the lace 20 is in the dual sliding lace guide 520 thereon. A closed lace loop 20*a* is supported on the front support member 600, as by lace guides 610, and the closed lace loop 20*a* passes through the dual sliding lace guide 520.

The dynamic lace to lace connector 500*a* corresponds with the lace connector 500 and additionally includes sliding lace guides 606*b* and 606*c*, which are offset from the dual sliding lace guide 520 on the dynamic lace to lace connector 520*a*. The dynamic lace to lace connector 500*b* corresponds with the lace connector 500 and additionally includes sliding lace guides 606*d* and 606*e*, which are in line with the dual sliding lace guide 520 on the dynamic lace to lace connector 520*b*. A sliding lace guide 606*a* is provided on the rear yoke support member 604.

Another example of a helmet harness system according to the invention is indicated at 700 in FIGS. 17 through 22. The system comprises a forehead support member 702, a first central support member 704, a second central support member 706, a third central support member 708, and a rear yoke support member 710. The members 702, 704, 706, 708 and 710 are unitary as they are connected to each other along the top of the system 700.

A dial lace tightening mechanism 712 is provided on the rear yoke support member 710. A lower lace 714 extends through lower lace guides 716*a*, 716*b*, and 716*c* into a terminal lace connector 718. Tension in the lace 714 can be adjusted up or down by manipulating the dial lace tightening mechanism 712. More tension will draw the lower ends of the members 702, 704, 706, 708 and 710 against the sides and forehead of a wearer and less tension will do the opposite.

Attachment members 720*a* and 720*b* are secured to the top of the system 700. The attachment members 720 also comprise dual sliding lace guides. Sliding lace guides 722*a* and 722*b* are secured to the top of the system 700. Closed lace loops 724*a*, 724*b*, and 724*c* are provided on the top of the system. Closed lace loop 724*a* is sliding supported in lower lace guides 716*a* (left and right), dual sliding lace guides 720*a* (left and right), and sliding lace guides 722*a* (left and right. Closed lace loops 724*b* and 724*c* are similarly supported for sliding movement.

Figure 23:
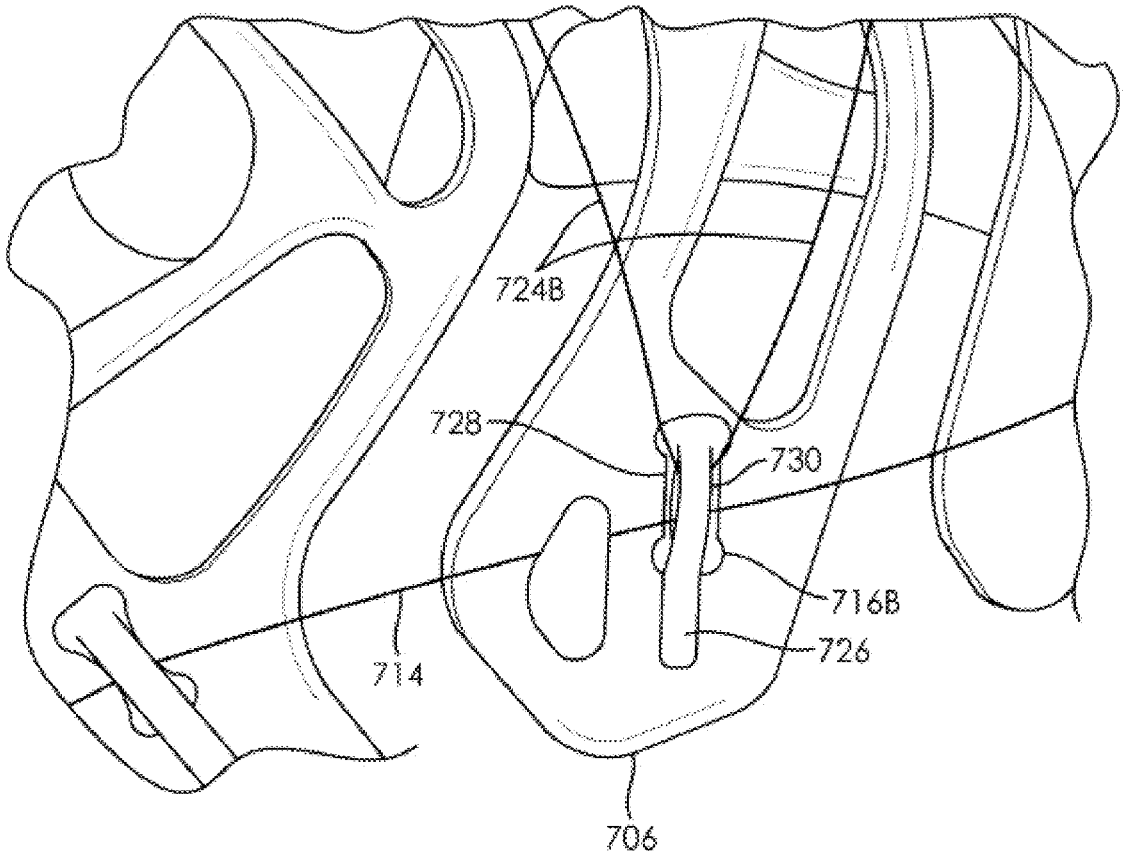
FIG. 23 is a perspective view of a portion of the helmet harness system shown in FIG. 17.
Figure 24:
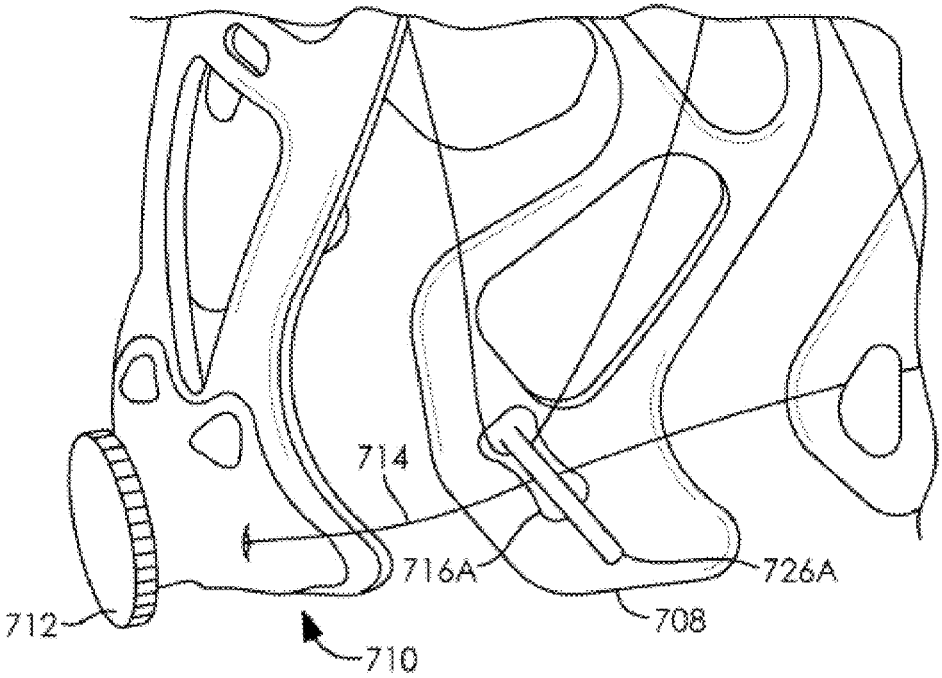
FIG. 24 is a perspective view of a portion of the helmet harness system shown in FIG. 17.

The lower lace guides 716*a*, 716*b*, and 716*c* constitute dynamic dual sliding lace guides and they are supported for sliding movement in slots indicated at 726*a*, 726*b*, and 726*c*. They self-adjust, as needed, to equalize tension in the closed lace loops 724 and the lower lace 714. As shown in FIG. 23, the lower lace guides 716 comprise a base 728, a top 730, and two posts (not visible) therebetween around which the lower lace 714 and the closed lace loop 724 extend. A backer, behind the support member 706 cooperates with the base 728 to keep the lower lace guides supported in the slot 726 for sliding movement.

Figure 25:
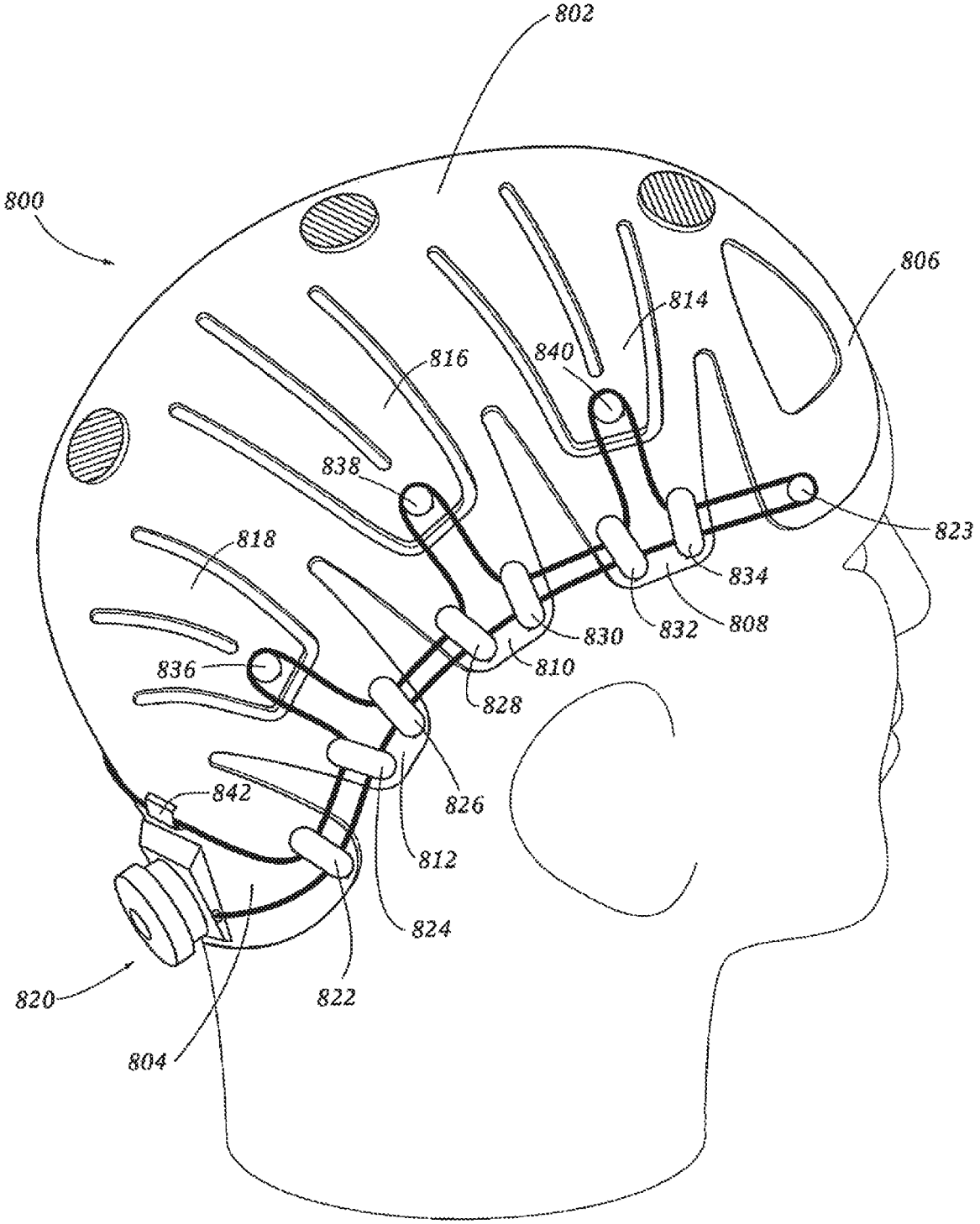
FIG. 25 is a perspective view showing an example of a helmet harness system according to the invention.

FIG. 25 is a perspective view of a helmet harness system according to another example of the invention. The parts of the system, indicated generally at 800 in FIG. 25, may be symmetrical along a longitudinal axis extending between the front of the system and the back of the system. The system comprises a central web 802 which extends, longitudinally, between a rear yoke support member 804 and a forehead support member 806. A first, front right support wing 808 extends downwardly from the central web 802. A second, middle right support wing 810 extends downwardly from the central web 802. A third, rear right support wing 812 extends downwardly from the central web 802.

A first, front right intermediate support wing 814 extends downwardly from the central web 802. A second, middle right intermediate support wing 816 extends downwardly from the central web 802. A third, rear right intermediate support wing 818 extends downwardly from the central web 802. The intermediate support wings 814, 816, and 818 extend a first given distance from the central web 802 and the support wings 808, 810, and 812 extend a second given distance. The second distance is longer than the first distance. In other words, the intermediate support wings 814, 816, and 818 are shorter than the support wings 808, 810, and 812.

In the FIG. 25 example, a portion of the first support wing 808 is on one side of the first intermediate support wing 814, and a second portion of the first support wing 808 is on the other side of the first intermediate support wing 814. Similarly, a portion of the second support wing 810 is on one side of the second intermediate support wing 816, and a second portion of the second support wing 810 is on the other side of the second intermediate support wing 816. In a like manner, a portion of the third support wing 812 is on one side of the third intermediate support wing 818, and a second portion of the third support wing 812 is on the other side of the third intermediate support wing 818.

A dial lace tightening mechanism 820 is supported on the rear yoke support member 804. A sliding lace guide 822 is supported on the rear yoke support member 804. A sliding lace guide 823 is supported on the forehead support member 806. A lower sliding lace path is defined between the lace guides 822 and 823 and a lace extending between these lace guides is supported in lace guides provided on the first, front right support wing 808, the second, middle right support wing 810, and the third, rear right support wing 812. Specifically, lace guides 824 and 826 are supported on the third, rear right support wing 812. Lace guides 828 and 830 are supported on the second, middle right support wing 810. Lace guides 832 and 834 are supported on the first, front right support wing 808. Tension in a lace in the lower lace path tends to pull the support wings 808, 810, and 812 downwardly.

An upper sliding lace path is defined between the lace guide 822 on the rear yoke support member 804 and the sliding lace guide 823 on the forehead support member 806 and a lace extending between these lace guides is supported in lace guides provided on the intermediate support wings 814, 816, and 818, and is also supported in lace guides provided on the support wings 808, 810, and 812. A lace guide 836 is supported on the third, rear right intermediate support wing 818. A lace guide 838 is supported on the second, middle right intermediate support wing 816. A lace guide 840 is supported on the first, front right intermediate support wing 814. A portion of a lace extending through lace guides 824 and 826 extends over or through the lace guide 836. Similarly, a portion of a lace extending through lace guides 828 and 830 extends over or through the lace guide 838. A portion of a lace extending through lace guides 832 and 834 extends over or through the lace guide 840. Tension in a lace in the upper lace path tends to pull the intermediate support wings 814, 816, and 818 downwardly.

As shown in FIG. 25, a sliding lace guide 842 is supported on the rear yoke support member 804. The portion of the lace that is in the upper lace path and is adjacent to the rear yoke support member 804 may extend through the sliding lace guide 842 to a similar lacing system on the other side of the system 800. Alternatively, that portion of the lace may be fixedly connected to the rear yoke support member 804.

Figure 26:
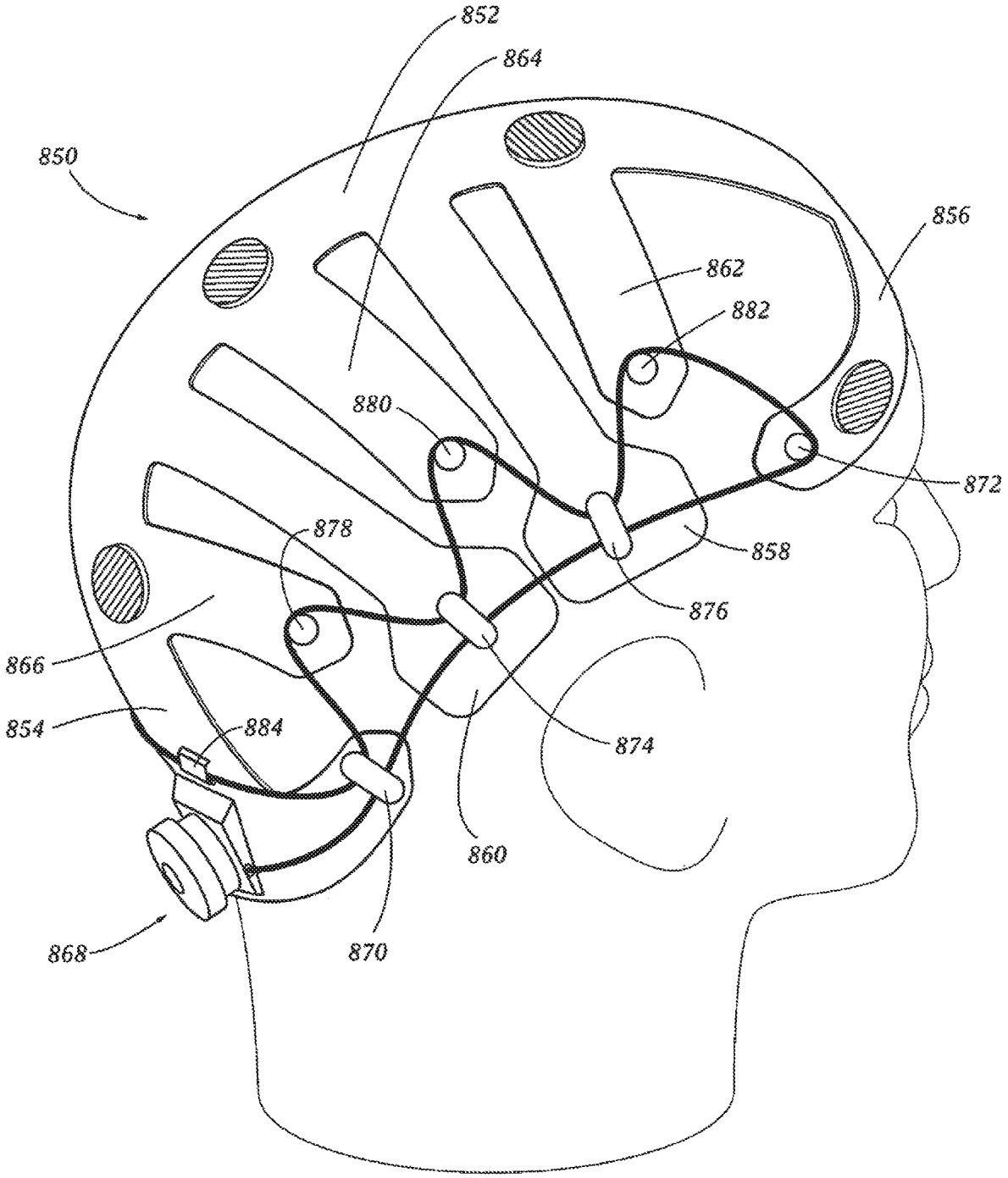
FIG. 26 is a perspective view showing an example of a helmet harness system according to the invention.
Figure 27:
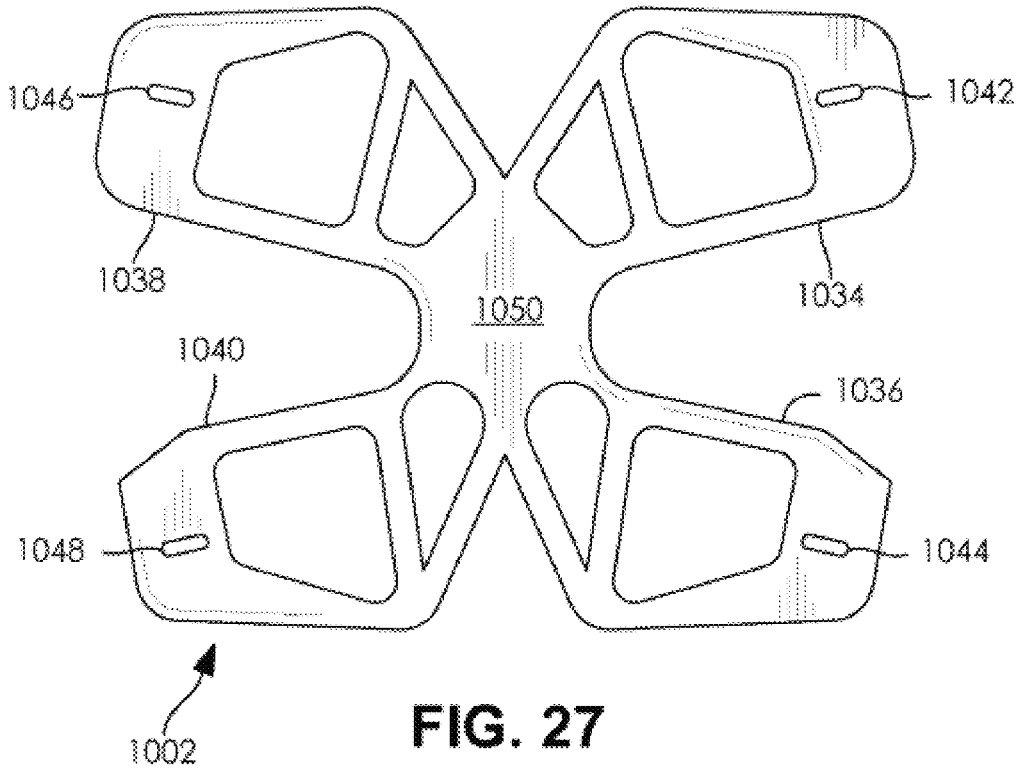
FIG. 27 is a plan view of an inner frame of a helmet harness according to the invention.
Figure 28:
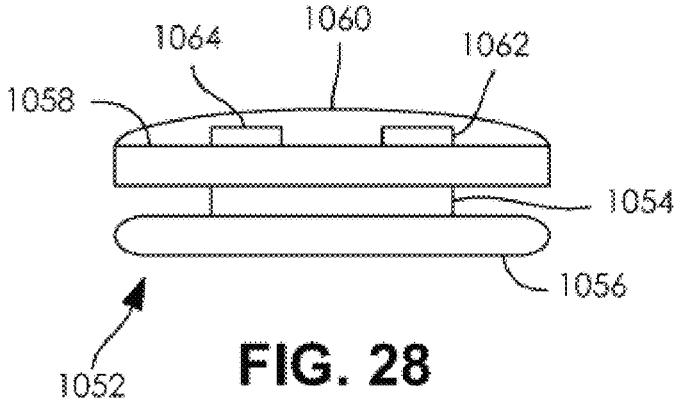
FIG. 28 is a side view of a cam slide suited for use in a helmet harness according to the invention.
Figure 29:
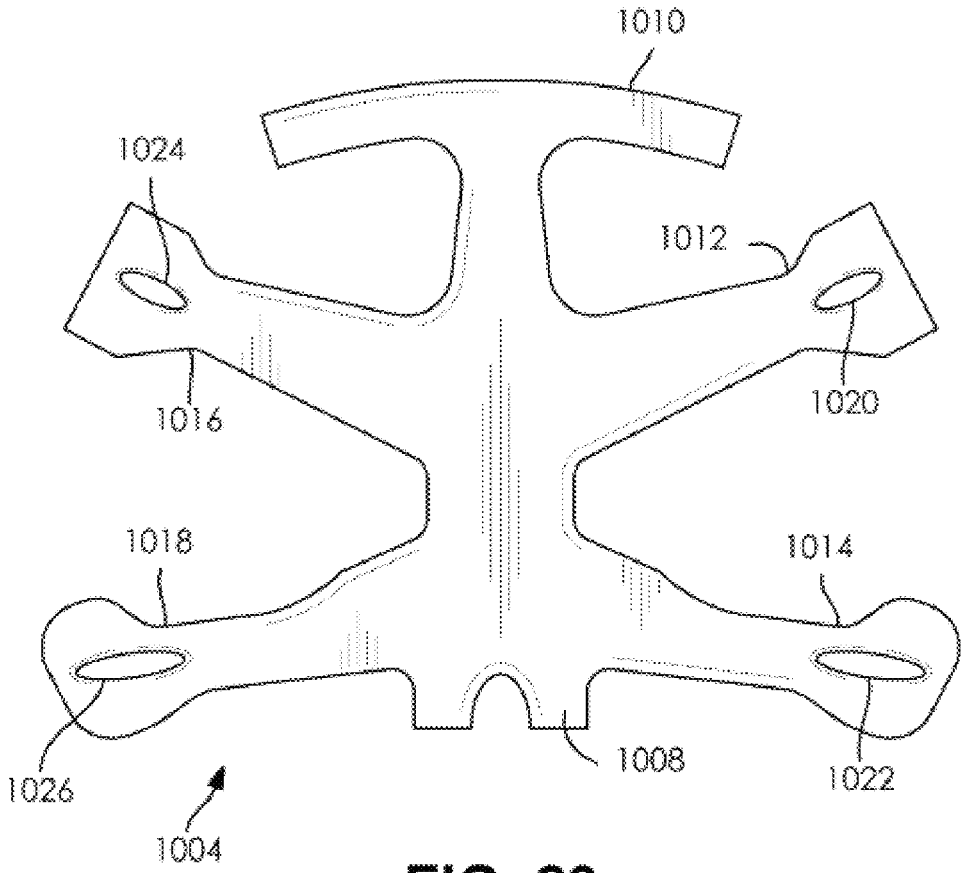
FIG. 29 is a plan view of an inner frame for a helmet harness according to the invention.

FIG. 26 is a perspective view of a helmet harness system according to another example of the invention. The parts of the system, indicated generally at 850 in FIG. 26, may be symmetrical along a longitudinal axis extending between the front of the system and the back of the system. The system comprises a central web 852 which extends, longitudinally, between a rear yoke support member 854 and a forehead support member 856. A first, front right support wing 858 extends downwardly from the central web 852. A second, rear right support wing 860 extends downwardly from the central web 852.

A first, front right intermediate support wing 862 extends downwardly from the central web 852. A second, middle right intermediate support wing 864 extends downwardly from the central web 852. A third, rear right intermediate support wing 866 extends downwardly from the central web 852. The intermediate support wings 862, 864, and 866 extend a first given distance from the central web 852 and the support wings 858 and 860 extend a second given distance. The second distance is longer than the first distance. In other words, the intermediate support wings 862, 864, and 866 are shorter than the support wings 858 and 860.

In the FIG. 26 example, a portion of the first, front right intermediate support wing 862 is between the forehead support member 856 and the first, front right support wing 858. The third, rear right intermediate support wing 866 is between the rear yoke support member 854 and the second, rear right support wing 860. The second, middle right intermediate support wing 864 is between the first, front right support wing 858 and the second, rear right support wing 860.

A dial lace tightening mechanism 868 is supported on the rear yoke support member 854. A sliding lace guide 870 is supported on the rear yoke support member 854. A sliding lace guide 872 is supported on the forehead support member 856. A lower sliding lace path is defined between the lace guides 870 and 872 and a lace extending between these lace guides is supported in lace guides provided on the first, front right support wing 858 and the second, rear right support wing 860. Specifically, lace guide 874 is supported on the second, rear right support wing 860. Lace guide 876 is supported on the first, front right support wing 858. Tension in a lace in the lower lace path tends to pull the support wings 860 and 858 downwardly.

An upper sliding lace path is defined between the lace guide 870 on the rear yoke support member 870 and the sliding lace guide 872 on the forehead support member 856 and a lace extending between these lace guides is supported in lace guides provided on the intermediate support wings 862, 864, and 866, and is also supported in lace guides provided on the support wings 858 and 860. A lace guide 878 is supported on the third, rear right intermediate support wing 866. A lace guide 880 is supported on the second, middle right intermediate support wing 864. A lace guide 882 is supported on the first, front right intermediate support wing 862. A portion of a lace extending through lace guides 870 and 874 extends over or through the lace guide 878. Similarly, a portion of a lace extending through lace guides 874 and 876 extends over or through the lace guide 880. A portion of a lace extending through lace guides 876 and 872 extends over or through the lace guide 882. Tension in a lace in the upper lace path tends to pull the intermediate support wings 862, 864, and 866 downwardly, away from the central web 852.

As shown in FIG. 26, a sliding lace guide 884 is supported on the rear yoke support member 854. The portion of the lace that is in the upper lace path and is adjacent to the rear yoke support member 854 may extend through the sliding lace guide 884 to a similar lacing system on the other side of the system 800. Alternatively, that portion of the lace may be fixedly connected to the rear yoke support member 854.

One or more of the lace guides 824, 826, 828, 830, 832, 834, 874, and 876 may be comprised of a cam slide secured in a slot for limited sliding movement.

In the helmet harness systems described above, and below, the lace guides and the lace tightening system cooperate so that the harness evenly and adjustably conforms to a wearer's head. When the lace (or laces) is tightened, it is tightened evenly along its length because the lace moves freely through the lace guides.

Turning now to FIGS. 27 through 31, a dual frame helmet harness system is described. The dual frame harness is indicated at 1000 in FIGS. 30 and 31 and comprises an inner frame 1002 and an outer frame 1004. The outer frame 1004 is adapted to be connected to a helmet shell (not shown) in a suitable manner. For example, connectors 1006 may be provided on the outer frame 1004 for connecting the outer frame to a helmet shell. Alternatively, adhesives, mechanical connectors, hook and loop connectors, and other connection means may be employed, singly or in combination, to secure the outer frame 1004 to a helmet shell.

The outer frame 1004 (FIG. 29) comprises a rear yoke support member attachment area 1008 (FIG. 29) and a forehead support member 1010. The frame 1004 further comprises four support wings, namely, a front right outer support wing 1012, a rear right outer support wing 1014, a front left outer support wing 1016, and a rear left outer support wing 1018. The front right outer support wing 1012 is provided with a slot indicated at 1020 and the rear right outer support wing 1014 is provided with a slot indicated at 1022. Similarly, the front left outer support wing 1016 is provided with a slot indicated at 1024 and the rear left outer support wing 1018 is provided with a slot indicated at 1026.

The rear yoke support member attachment area 1008, the forehead support member 1010, the front right outer support wing 1012, the rear right outer support wing 1014, the front left outer support wing 1016, and the rear left outer support wing 1018 are connected to and connected to each other through a central web 1028. The connection may be such that the central web 1028 is integral with the attachment area 1008, the forehead support member 1010, and the wings 1012, 1014, 1016, and 1018 wings. Alternatively, the connection may be by way of adhesive or mechanical connectors or the like.

Figure 30:
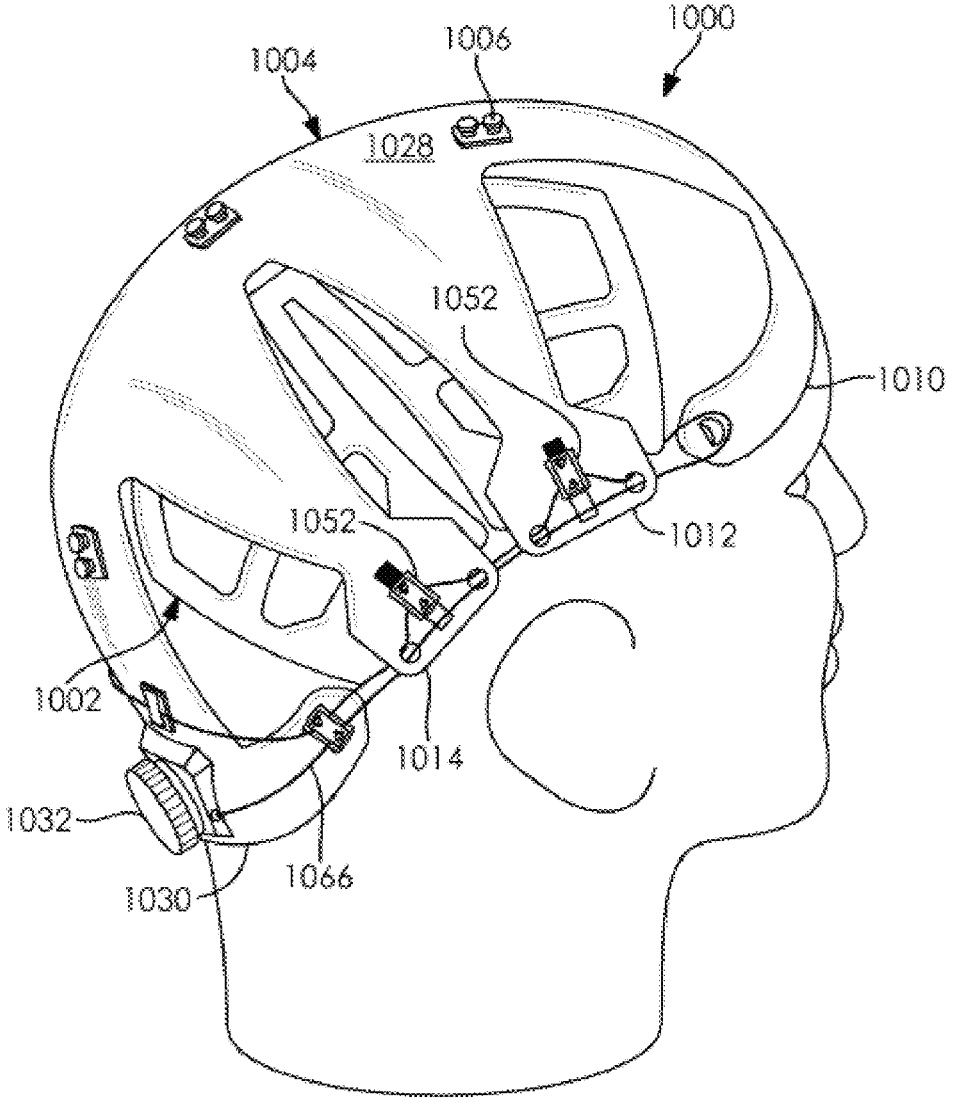
FIG. 30 is a perspective view of an assembled helmet harness, according to the invention, positioned on a head.
Figure 31:
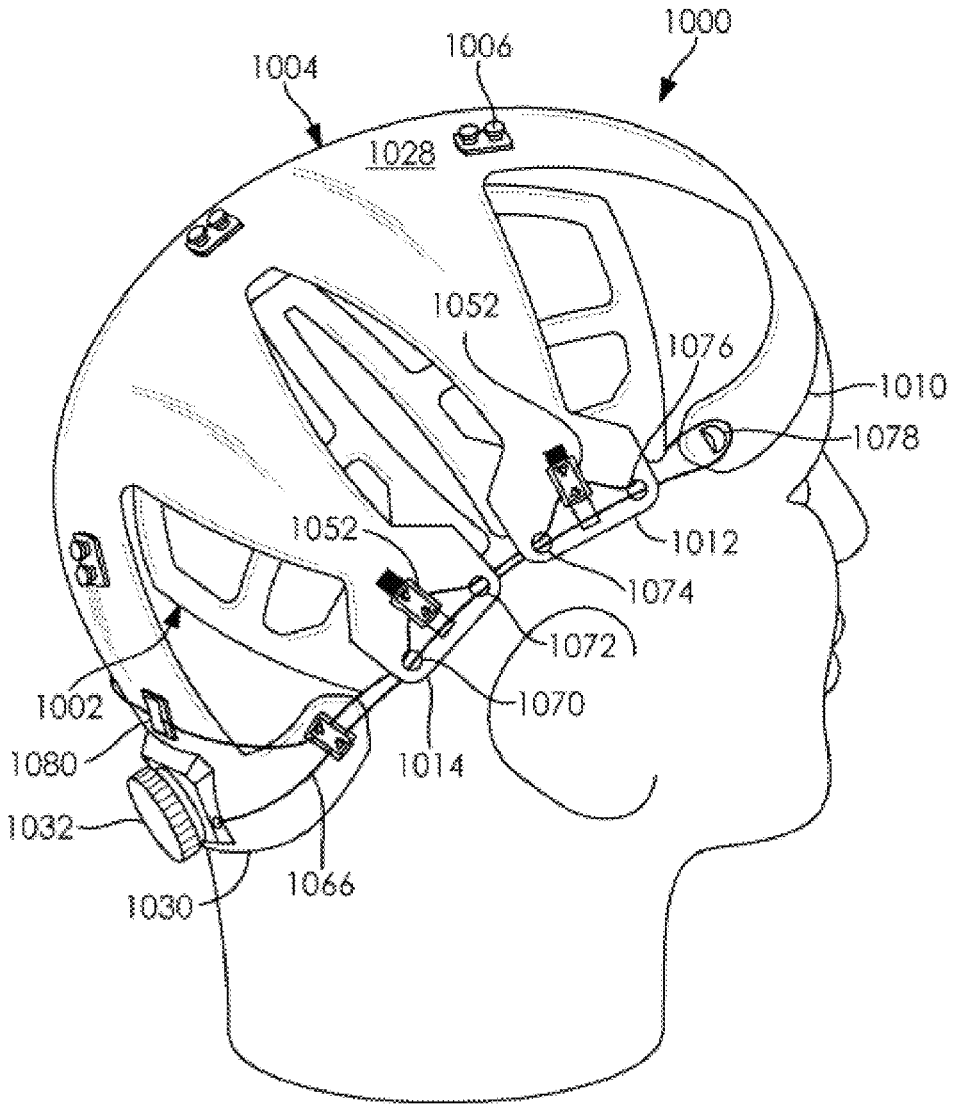
FIG. 31 is a perspective view of the assembled helmet harness shown in FIG. 30 with arrows indicating that the harness accommodates and absorbs rotational forces applied to a helmet in which the harness is secured.

A rear yoke support member 1030 (FIGS. 30 and 31) extends from the web 1028 and may be connected thereto through the rear yoke support member attachment area 1008. Alternatively, as shown in FIGS. 30 and 31, the rear yoke support member may be integrally connected with the central web 1028. In either case, a dial lace tightening mechanism 1032 is connected to and supported on the rear yoke support member 1030.

The inner 1002 (FIG. 2) comprises four support wings, namely, a front right inner support wing 1034, a rear right inner support wing 1036, a front left inner support wing 1038, and a rear left inner support wing 1040. The front right inner support wing 1034 is provided with a slot indicated at 1042 and the rear right inner support wing 1036 is provided with a slot indicated at 1044. Similarly, the front left inner support wing 1038 is provided with a slot indicated at 1046 and the rear left inner support wing 1040 is provided with a slot indicated at 1048.

The front right inner support wing 1034, the rear right inner support wing 1036, the front left inner support wing 1038, and the rear left inner support wing 1040 are connected to and connected to each other through a central web 1050. The connection may be such that the central web 1050 is integral with the front right inner support wing 1034, the rear right inner support wing 1036, the front left inner support wing 1038, and the rear left inner support wing 1040. Alternatively, the connection may be by way of adhesive or mechanical connectors or the like.

The central webs 1028 and 1050 may be fixedly connected to each other mechanically, adhesively, or otherwise. The wings 1012, 1014, 1016, and 1018 wings may be connected to the front right inner support wing 1034, the rear right inner support wing 1036, the front left inner support wing 1038, and the rear left inner support wing 1040, respectively, to permit sliding movement therebetween. This sliding connection can be achieved through a cam slide type device 1052 shown from the side in FIG. 28. The cam slide 1052 comprises a central portion 1054, an inner flange 1056, and an outer flange 1058. A lace guide flange 1060 extends upwardly from the outer flange 1058 and has at least one lace guide opening 1062 and, in the configuration shown in FIG. 28, a second lace guide opening 1064.

The cam slide 1052 is configured so that the central portion 1054 may be positioned in, and retained in, the slots in the inner frame 1002 and the corresponding slots in the outer frame 1004. Further, the cam slide 1052 is configured, relative to the slots in the inner frame 1002 and the slots in the outer frame 1004 so that, when corresponding slots such as slots 1020 and 1042 are aligned, the inner flange 1056 of the cam slide 1052 may be inserted into and through the slot 1020, and into and through the slot 1042 so that the central portion 1054 of the cam slide 1052 is within both slots 1020 and 1042 and so that a portion of the front right outer support wing 1012 surrounding the slot 1020 and a portion of the front right inner support wing surrounding the slot 1042 are held captive between the cam slide flanges 1056 and 1058. The length of the central portion 1054 of the cam slide 1052 and the length of the slots 1042, 1044, 1046, and 1048 are controlled so that sliding movement of the central portion 1054 in the slots is prevented or restricted to a short distance. The length of the central portion 1054 of the cam slide 1052 and the length of the slots 1020, 1022, 1024, and 1026 are controlled so that sliding movement of the central portion 1054 in the slots is permitted over a longer distance. This provides a structure where the extremities of the inner frame 1002 and the extremities of the outer frame 1004 can float, relative to each other.

A lacing system is provided in the helmet harness 100 and it comprises a lace 1066 with two ends which extend into the dial lace tightening mechanism 1032. From the side of the helmet harness visible in FIGS. 30 and 31, the lace 1066 extends from the dial lace tightening mechanism 1032, through a lace guide 1068, openings 1070 and 1072 in the rear right outer support wing 1014, openings 1074 and 1076 in the front right outer support wing 1012, and around a lace guide 1078 on the forehead support member 1010. The lace 1066 returns to the rear of the helmet harness 1000 through opening 1076, a lace guide opening in the cam slide 1052 on the front right outer support wing 1012, openings 1074 and 1072, a lace guide opening in the cam slide 1052 on the rear right outer support wing 1014, opening 1070, lace guides 1068 and 1080, and around to the other side of the helmet harness 1000 where it can be similarly laced.

The helmet harness system described above may be combined with other features now known or hereinafter invented. For example, the harness system described above may include an energy absorbing layer and/or a sliding facilitator such as those shown in patent application Ser. No. 13/263,981 published Feb. 21, 2013 under publication no. US 2013/0042397, the entire disclosure of which is incorporated herein by reference. A different lace tightening mechanism may be substituted for the dial lace tightening mechanism. These and other modifications are deemed to be within the scope and spirit of the invention.

Figure 32:
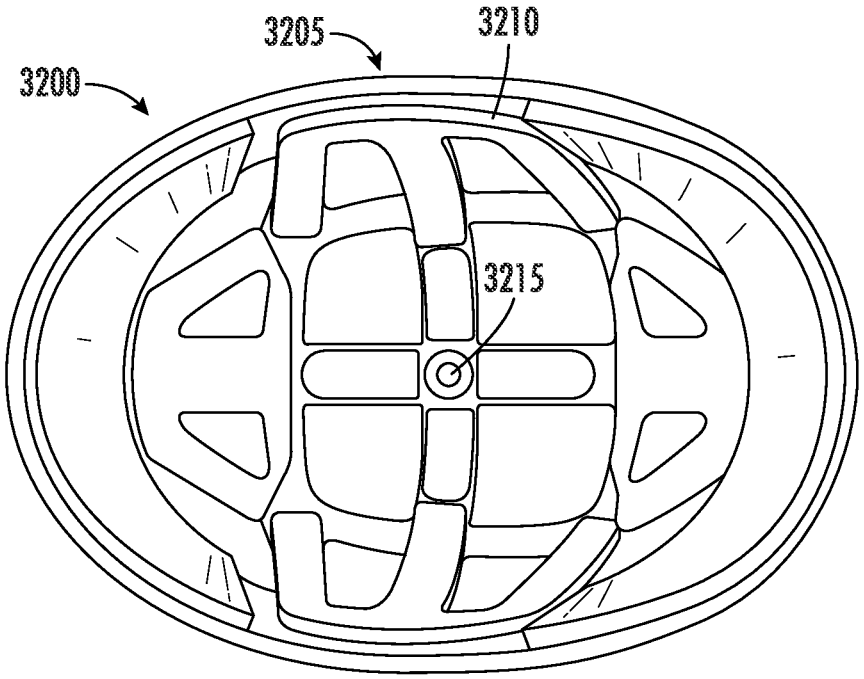
FIG. 32 is a bottom view of one embodiment of a helmet harness system.

FIG. 32 is a bottom view of one embodiment of a helmet harness system 3200, showing an outer shell 3205, an inner shell 3210, and a grommet 3215 which connects the outer shell 3205 and the inner shell 3210. As discussed below, the helmet harness 3200 affords freedom of movement with respect to yaw, roll, and pitch (i.e., six degrees of freedom).

The grommet 3215 is preferably sized and of a material such that the outer shell 3205 and the inner shell 3210 can move with respect to each other when a force is applied. However, grommet 3215 is preferably sized and of a material such that it slightly grips the outer shell 3205 and the inner shell 3210 so that the outer shell 3205 does not freely bounce around on, or freely move with respect to, the inner shell 3210 in normal use, such as when the user is riding on a smooth road and looking straight ahead, as unrestricted bouncing and movement might be distracting and undesirable to the user.

Figure 33:
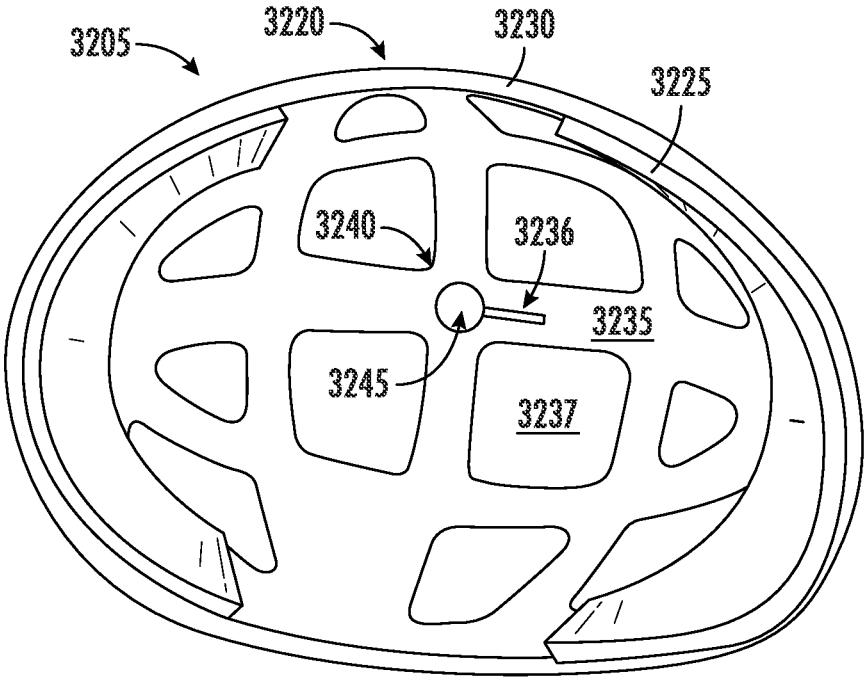
FIG. 33 is a bottom view of the outer shell of the helmet harness system.

FIG. 33 is a bottom view of the outer shell 3205 of the helmet harness system 3200, showing an outer frame 3220 and a plurality of pads 3225. The outer frame 3220 has a rim 3230, and a plurality of longitudinal and lateral ribs 3235 connected to the rim 3230, with some of the ribs 3235 meeting at an apex 3240. The apex 3240 has a hole 3245 to accommodate the grommet 3215. The longitudinal and lateral ribs 3235 cross and connect to form a plurality of holes with respect to each other and with respect to the rim 3230, which allows air to flow through the helmet harness and reduces the weight of the helmet harness.

Figure 34:
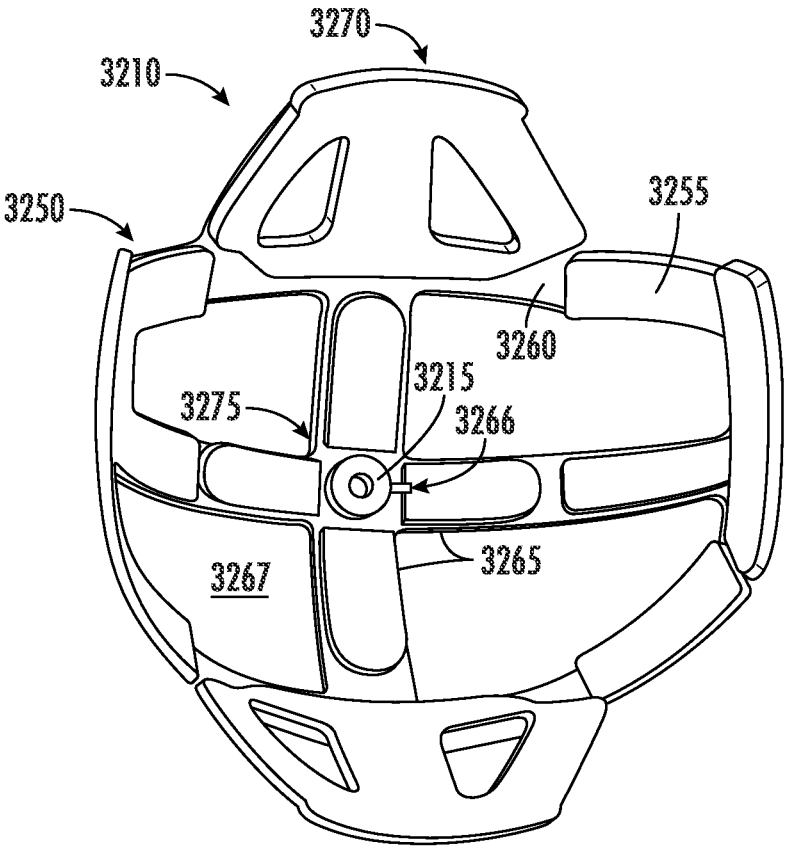
FIG. 34 is a bottom view of the inner shell of the helmet harness system.

FIG. 34 is a bottom view of the inner shell 3210 of the helmet harness system 3200, showing an inner frame 3250 and a plurality of pads 3255. The frame 3250 has a rim 3260, longitudinal and lateral ribs 3265 connected to the rim 3260, with the ribs 3265 meeting at an apex 3275, and a pair of ear lobes 3270. The longitudinal and lateral ribs 3265 cross and connect to form a plurality of holes with respect to each other and with respect to the rim 3260, which allows air to flow through the helmet harness and reduces the weight of the helmet harness. The ear lobes 3270 provide protection and comfort for the ears of the user. The apex 3275 also has a hole (not shown, but similar or identical to hole 3245), to accommodate the grommet 3215.

The pads 3255 and 3255 provide cushioning and protection with respect to impacts. Further, pads 3225 and 3255 provide additional protection with respect to impacts, as compared to either section 3225 or 3255 alone.

The plurality of pads 3225 and 3255 are preferably placed, and preferably of a size, thickness, and number, such that the frames 3220 and 3350 do not touch the skin or scalp of the user, thereby providing maximum comfort to the user.

The ribs 3235 and 3265 are preferably of a size and number to minimize the weight of the helmet harness system 3200, and to allow air to flow through the helmet harness system 3200, while still providing rigidity and strength, such that the helmet is properly supported on the user's head for safety and comfort, and such that the helmet harness system 3200 will be sufficiently durable to withstand normal operation (and accidents).

The hole 3245 in the frame 3220 and the corresponding hole in the frame 3350 are preferably located at or near the apex 3240 of the frame 3220 and the apex 3275 of the frame 3350. The grommet 3215 is preferably a flexible grommet so that it flexibly connects the frame 3220 and the frame 3350 and allows them to move (yaw, pitch, and roll) with respect to each other.

Figure 35:
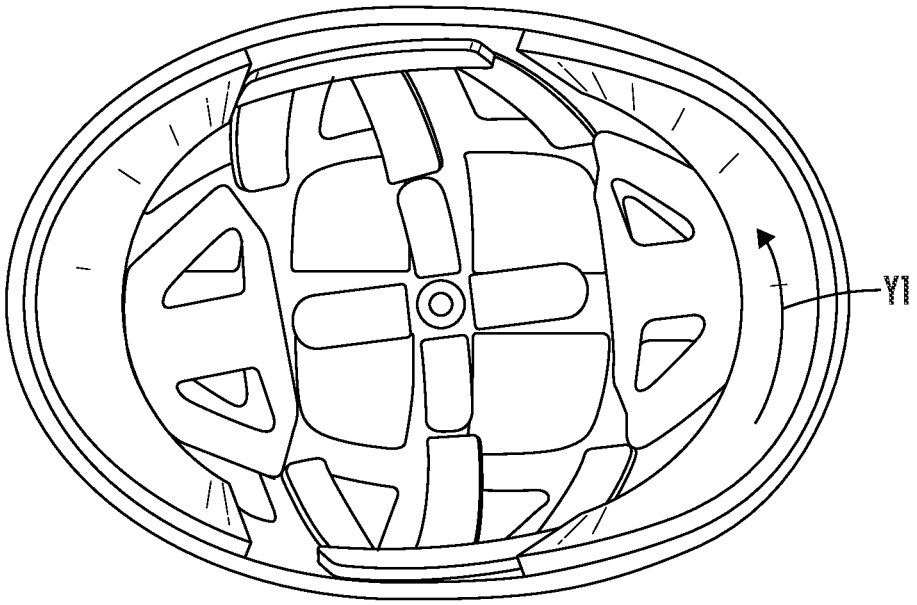
FIGS. 35 and 36 are bottom views showing the outer shell and the inner shell yawing with respect to each other.
Figure 36:
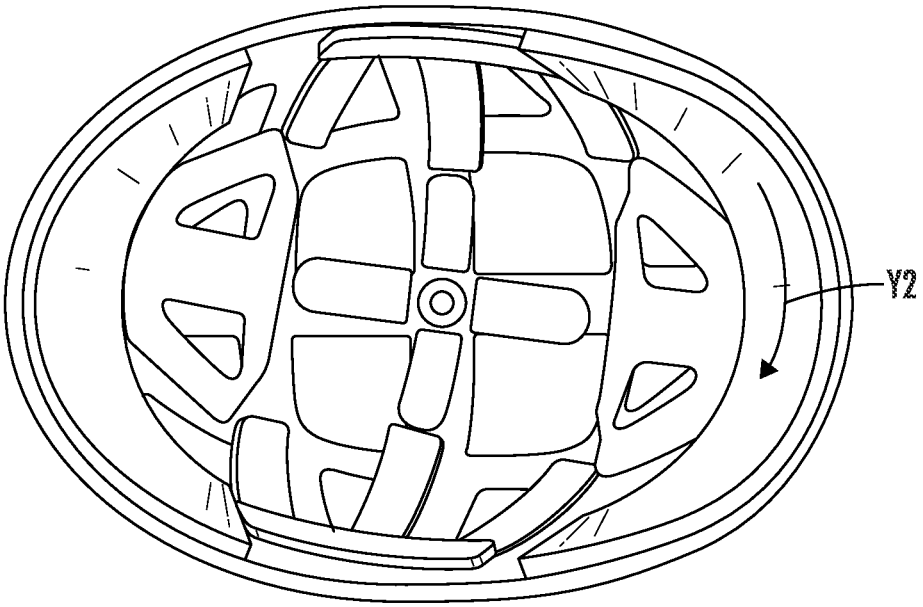

FIGS. 35 and 36 are bottom views of the helmet harness system 3200, showing the outer shell 3205 and the inner shell 3210 yawing with respect to each other, as indicated by the arrows Y1, Y2.

Figure 37:
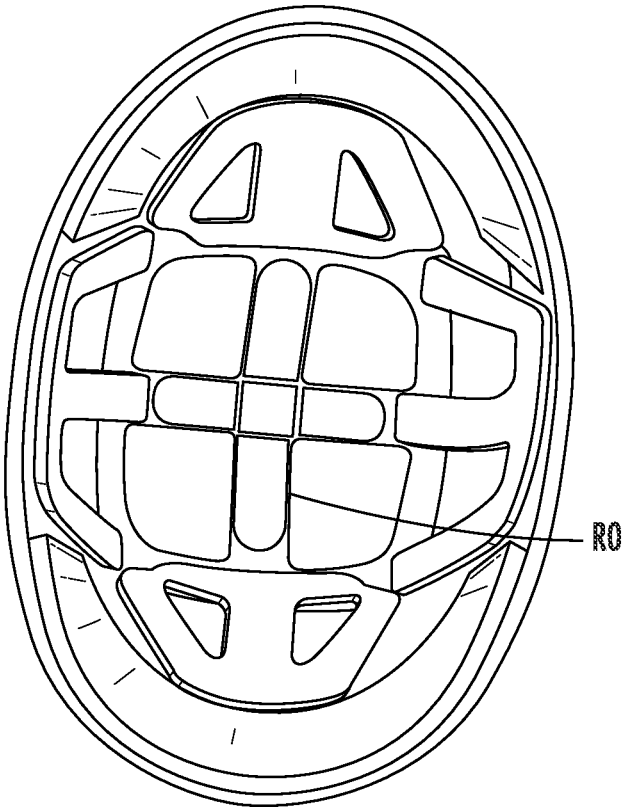
FIGS. 37-39 are bottom views of the helmet harness system showing the outer shell and the inner shell rolling with respect to each other.
Figure 38:
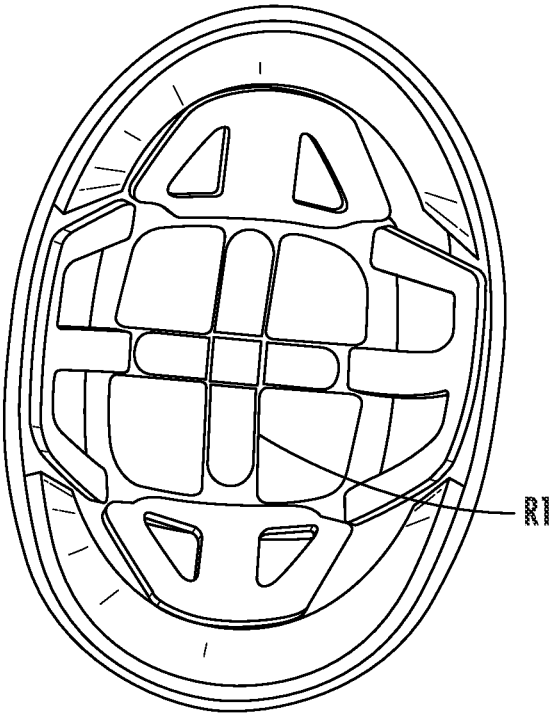
Figure 39:
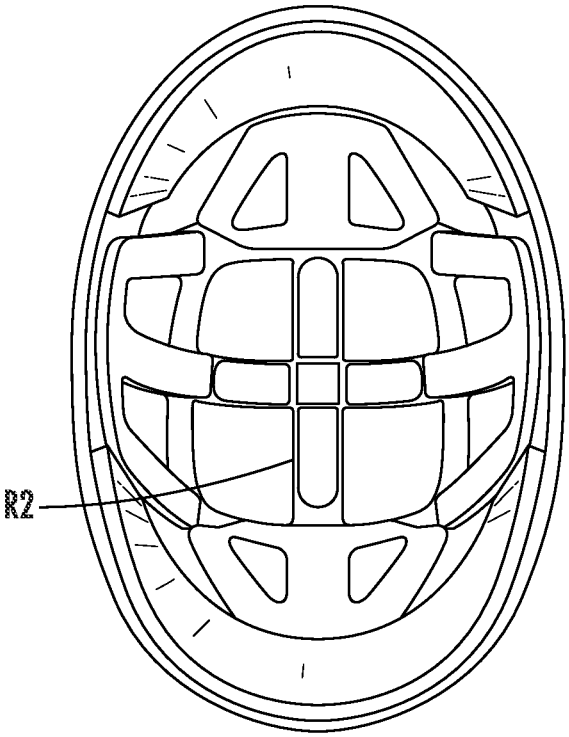

FIGS. 37-39 are bottom views of the helmet harness system 3200, showing the outer shell 3205 and the inner shell 3210 rolling with respect to each other. FIG. 37 shows an initial or neutral position R0, FIG. 38 shows a first roll R1, and FIG. 39 shows a second, opposite roll R2.

Figure 40:
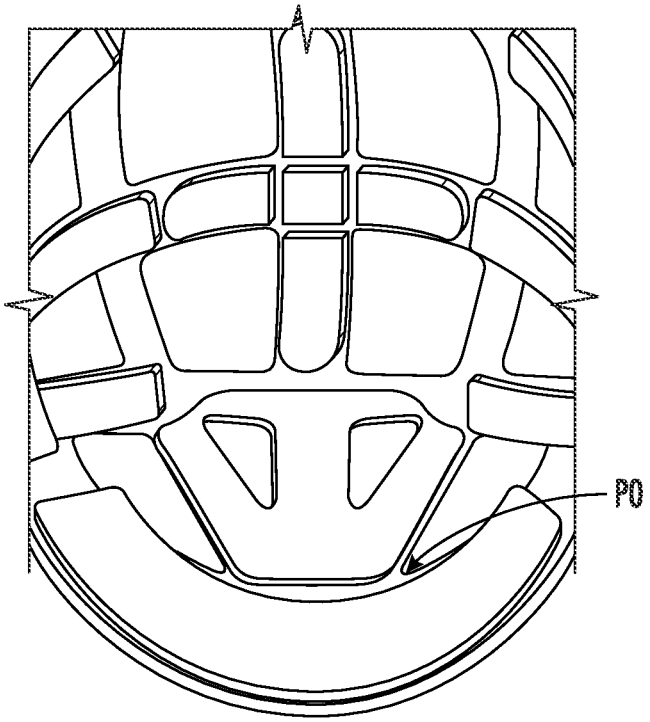
FIGS. 40-42 are bottom views of the helmet harness system showing the outer shell and the inner shell pitching with respect to each other.
Figure 41:
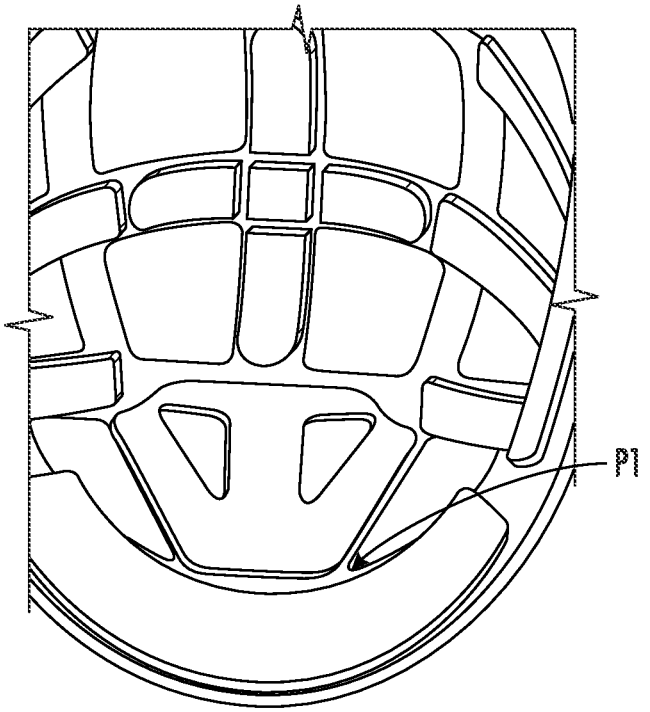
Figure 42:
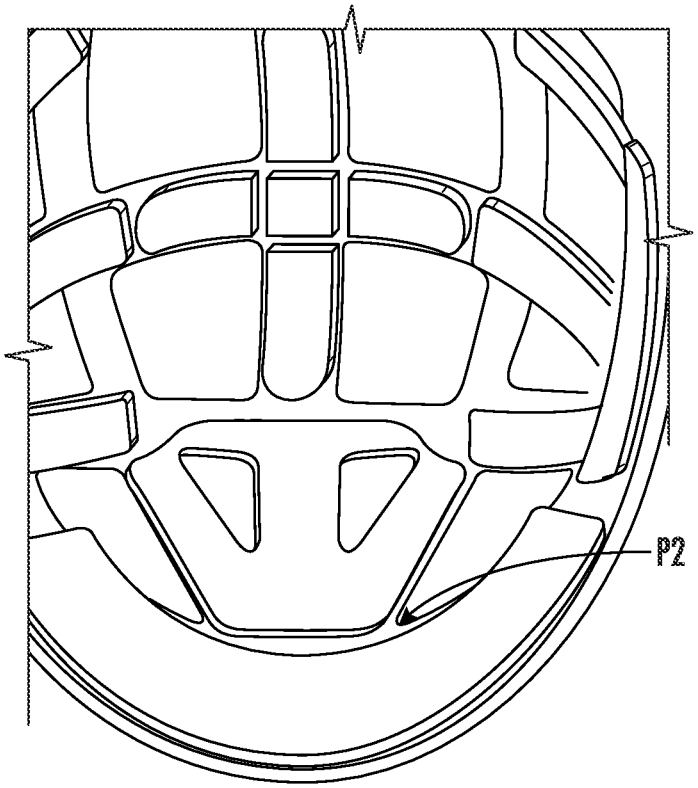

FIGS. 40-42 are bottom views of the helmet harness system 3200, showing the outer shell 3205 and the inner shell 3210 pitching with respect to each other. FIG. 40 shows a neutral position P0, FIG. 41 shows a forward-pitched position P1, and FIG. 42 shows a backward-pitched position P2.

Figure 43:
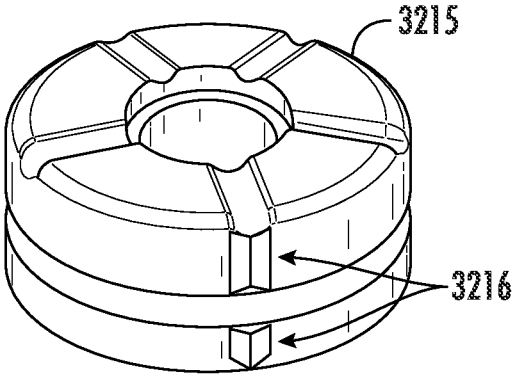
FIG. 43 is a perspective view of the grommet of the helmet harness system.
Figure 44:
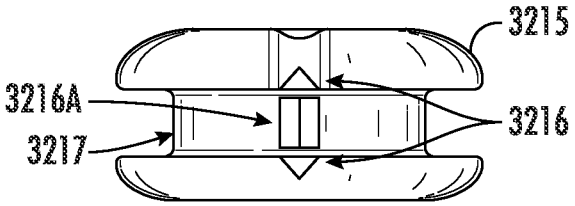
FIG. 44 is a side view of the grommet of the helmet harness system.

FIG. 43 is a perspective view of the grommet 3215 of the helmet harness system; and FIG. 44 is a side view of the grommet 3215 of the helmet harness system. The grommet 3215 is sized, and is stiff enough, to allow the grommet 3215 to be inserted into the holes in the outer frame 3220 and the inner frame 3250, and to hold the outer shell 3205 and the inner shell 3210 together in normal use, but flexible enough to allow the outer shell 3205 and the inner shell 3210 to roll, yaw, and pitch with respect to each other. The grommet 3215 is also preferably sized so that the outer shell 3205 and the inner shell 3210 are flexibly connected to each other so that the outer shell 3205 and the inner shell 3210 can move with respect to each other, but not so loosely connected that the outer shell 3205 bounces freely around on the inner shell 3210, as that might be distracting and undesirable to the user.

Returning to FIGS. 33, 34, 43, and 44, an auto-alignment feature is disclosed. It is desirable, when the outer shell 3205 and the inner shell 3210 shift with respect to each other, that they automatically realign. FIG. 33 shows a ridge 3236, in the outer frame 3220, which extends forward from the hole 3245. FIG. 34 shows a ridge 3266, in the inner frame 3250, which extends forward from the hole in the apex 3275. FIGS. 43 and 44 show one or more grooves 3216 in the grommet 3215. The ridges 3236, 3266 fit into the grooves 3216.

Thus, when a force is applied to the helmet, one or both of the ridges 3236, 3266 lift out of the groove 3216 so that the outer shell 3205 can rotate with respect to the inner shell 3210. Then, when the force is removed, and the outer shell 3205 rotates back into a normal position, the ridge 3236 and/or 3266 will re-engage the groove 3216 and retain the outer shell 3205 and the inner shell 3210 in an aligned position.

In an alternative implementation, a ridge 3236, 3266 may not be on the surface of the frame 3220, 3250, but may be a ridge or key inside the hole in the apex of the frame 3220, 3250, and the groove 3216A may be on the outer surface of the shaft of the grommet 3215. Thus, again, the outer shell 3205 and the inner shell 3210 will automatically revert to the aligned position.

In another alternative implementation, the hole in the apex of the frame 3220, 3250, and the grommet 3215, are not round but are elongate, such as an oval or a rectangle. Then, when a force is applied to the helmet, the outer shell 3205 can rotate with respect to the inner shell 3210 by torquing and twisting the grommet shaft 3217. Then, when the force is removed, the grommet shaft 3217 will revert to its normal (not twisted) position, thereby rotating the outer shell 3205 and the inner shell 3210 back to an aligned position.

Figure 45:
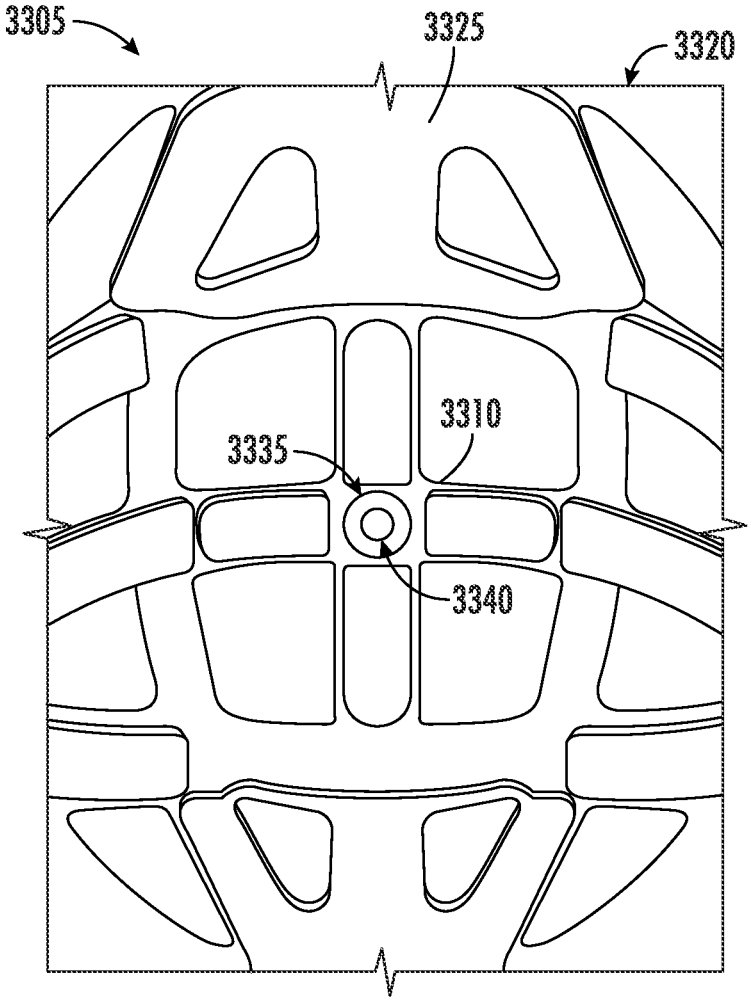
FIG. 45 is a partial bottom view of another embodiment of a helmet harness system.

FIG. 45 is a partial bottom view of another embodiment of an outer shell 3305. The outer shell 3305 has an outer frame 3320, a plurality of pads 3325, and a dampener 3310. Also shown are an insert 3335, such as a threaded insert, and a fastener 3340, such as a screw. The fastener 3340 is inserted through a grommet 3315 in the apex 3275 of the inner frame 3250 and into the insert 3335, thereby holding the outer shell 3305 and the inner shell 3210 together. The dampener section 3310 is made of a resilient material, such as but not limited to silicone, foam, or urethane, and provides an additional degree of shock absorption. The fastener 3340 preferably has a flat or low head so that it does not contact the head of the user.

Figure 46:
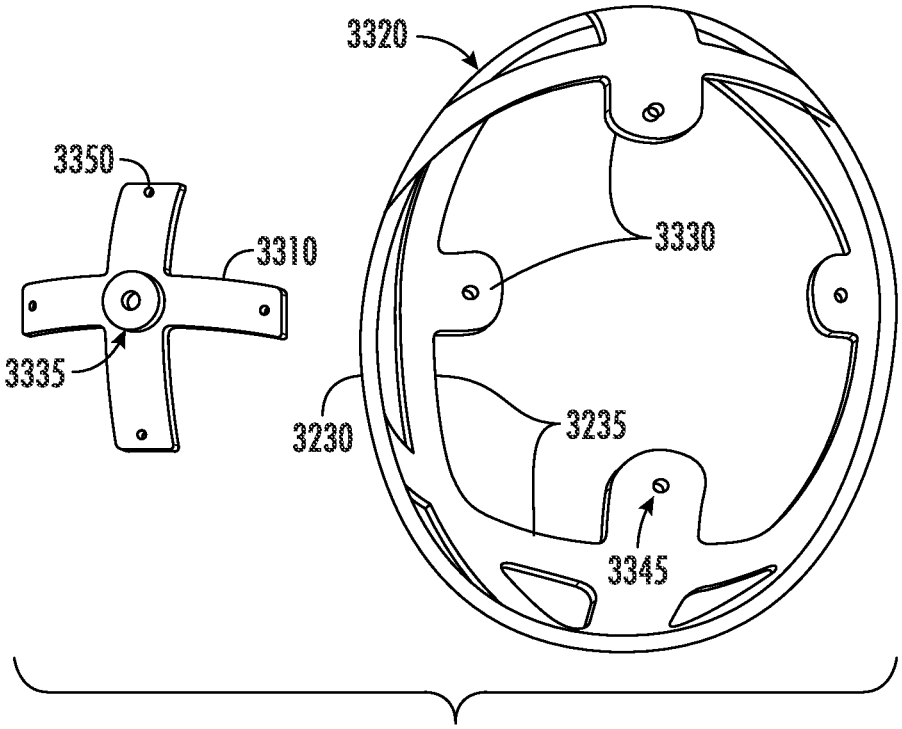
FIG. 46 is a dissembled view of the outer shell.

FIG. 46 is a dissembled view of the outer shell 3305 showing the outer frame 3320 and the dampener 3310. The outer frame 3320 has a plurality of longitudinal and lateral ribs 3235 which cross and are connected to the rim 3230. In addition, the ribs 3235 also have lobes 3330 extending therefrom, with the lobes 3330 having a plurality of holes 3345, such as rivet holes. The outer frame 3320 therefore does not have an apex 3240 such as is present in the earlier embodiment.

Figure 47:
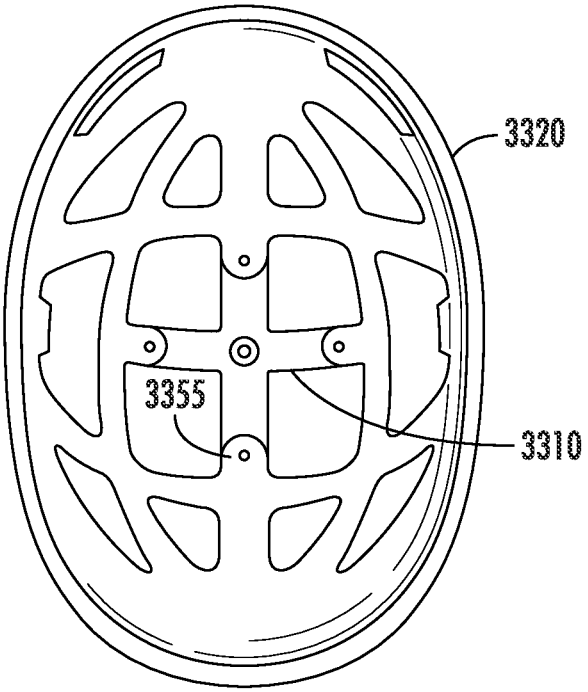
FIG. 47 is a partially assembled view of the outer shell.

The dampener 3310 is cross- or "X"-shaped with four legs, with a hole 3350, such as a rivet hole, toward the end of each leg of the dampener 3310. Fasteners, 3355, such as rivets (FIG. 47) are preferably used to attach the dampener 3310 to the outer frame 3320. The FIG. 47 is a partially assembled view of the outer shell 3305 showing the outer frame 3320 and the dampener 3310 held together by fasteners 3355.

Figure 48:
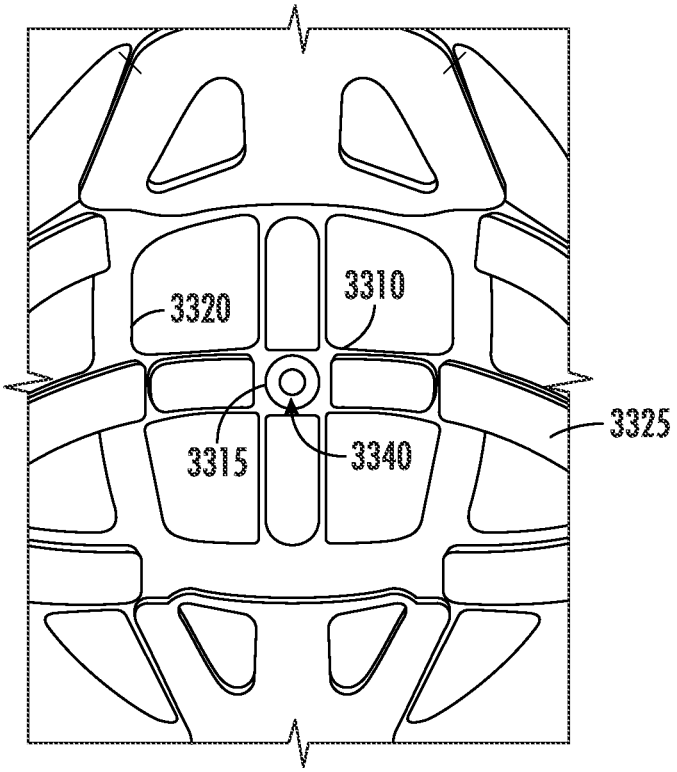
FIG. 48 is an assembled view of the outer shell.

FIG. 48 is an assembled view of the outer shell 3305 showing the outer frame 3320, the dampener 3310, and the pads 3325.

Figure 49:
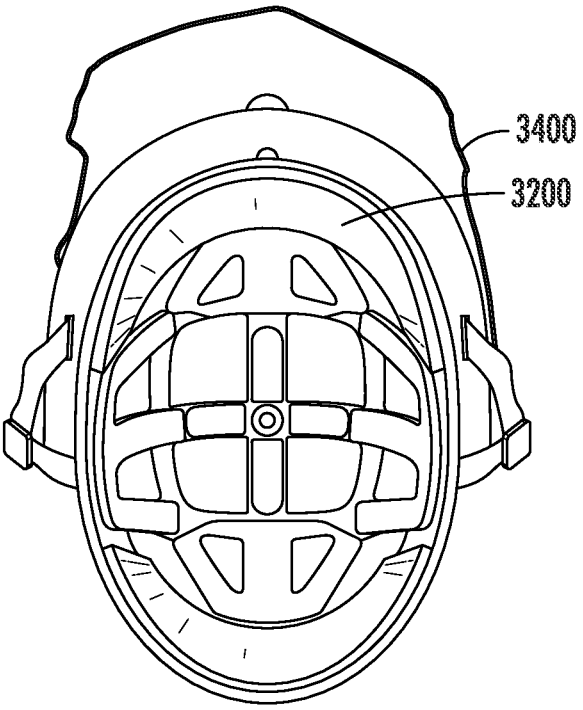
FIG. 49 illustrates a helmet harness system installed in an exemplary helmet shell.

FIG. 49 illustrates a helmet harness system 3200 installed in an exemplary helmet shell 3400.

Unless otherwise defined, all terms (including technical and scientific terms) used herein have the same meaning as commonly understood by one of ordinary skill in the art to which this subject matter belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. For brevity and/or clarity, well-known functions or constructions may not be described in detail herein.

The term "exemplary" is used herein to mean serving as an example, instance, or illustration. Any aspect or design described herein as "exemplary" is not necessarily to be construed as preferred or advantageous over other aspects or designs. Similarly, examples are provided herein solely for purposes of clarity and understanding and are not meant to limit the subject innovation or portion thereof in any manner.

The terms "for example" and "such as" mean "by way of example and not of limitation." The subject matter described herein is provided by way of illustration for the purposes of teaching, suggesting, and describing, and not limiting or restricting. Combinations and alternatives to the illustrated embodiments are contemplated, described herein, and set forth in the claims.

For convenience of discussion herein, when there is more than one of a component, that component may be referred to herein either collectively or singularly by the singular reference numeral unless expressly stated otherwise or the context clearly indicates otherwise. For example, components N (plural) or component N (singular) may be used unless a specific component is intended. Also, the singular forms "a," "an," and "the" are intended to include the plural forms as well, unless expressly stated otherwise or the context indicates otherwise.

It will be further understood that the terms "includes," "comprises," "including," and/or "comprising" specify the presence of stated features, steps, operations, elements, and/or components, but do not preclude the presence or addition of one or more other features, steps, operations, elements, components, and/or groups thereof unless explicitly stated otherwise or the context clearly requires otherwise. The terms "includes," "has" or "having" or variations in form thereof are intended to be inclusive in a manner similar to the term "comprises" as that term is interpreted when employed as a transitional word in a claim.

It will be understood that when a component is referred to as being "connected" or "coupled" to another component, it can be directly connected or coupled or coupled by one or more intervening components unless expressly stated otherwise or the context clearly indicates otherwise.

The term "and/or" includes any and all combinations of one or more of the associated listed items. As used herein, phrases such as "between X and Y" and "between about X and Y" should be interpreted to include X and Y unless expressly stated otherwise or the context clearly indicates otherwise.

Terms such as "about", "approximately", and "substantially" are relative terms and indicate that, although two values may not be identical, their difference is such that the apparatus or method still provides the indicated or desired result, or that the operation of a device or method is not adversely affected to the point where it cannot perform its intended purpose. As an example, and not as a limitation, if a height of "approximately X inches" is recited, a lower or higher height is still "approximately X inches" if the desired function can still be performed or the desired result can still be achieved.

While the terms vertical, horizontal, upper, lower, bottom, top, and the like may be used herein, it is to be understood that these terms are used for ease in referencing the drawing and, unless otherwise indicated or required by context, does not denote a required orientation.

The different advantages and benefits disclosed and/or provided by the implementation(s) disclosed herein may be used individually or in combination with one, some or possibly even all of the other benefits. Furthermore, not every implementation, nor every component of an implementation, is necessarily required to obtain, or necessarily required to provide, one or more of the advantages and benefits of the implementation.

Conditional language, such as, among others, "can", "could", "might", or "may", unless specifically stated otherwise, or otherwise understood within the context as used, is generally intended to convey that certain embodiments preferably or optionally include certain features, elements and/or steps, while some other embodiments optionally do not include those certain features, elements and/or steps. Thus, such conditional language indicates, in general, that those features, elements and/or step may not be required for every implementation or embodiment.

The subject matter described herein is provided by way of illustration only and should not be construed as limiting the nature and scope of the subject invention. While examples of aspects of the subject invention have been provided above, it is not possible to describe every conceivable combination of components or methodologies for implementing the subject invention, and one of ordinary skill in the art may recognize that further combinations and permutations of the subject invention are possible. Furthermore, the subject invention is not necessarily limited to implementations that solve any or all disadvantages which may have been noted in any part of this disclosure. Various modifications and changes may be made to the subject invention described herein without following, or departing from the spirit and scope of, the exemplary embodiments and applications illustrated and described herein. Although the subject matter presented herein has been described in language specific to components used therein, it is to be understood that the subject invention is not necessarily limited to the specific components or characteristics thereof described herein; rather, the specific components and characteristics thereof are disclosed as example forms of implementing the subject invention. Accordingly, the disclosed subject matter is intended to embrace all alterations, modifications, and variations, that fall within the scope and spirit of any claims that are written, or may be written, for the subject invention.

The invention claimed is:

1. A helmet harness comprising:

an outer shell having an outer frame, a dampener, and a first plurality of pads;

the outer frame having a first rim, a plurality of longitudinal ribs connected to the first rim, and a plurality of lateral ribs connected to the first rim, a longitudinal rib of the plurality of longitudinal ribs having a lobe extending therefrom, the lobe on the longitudinal rib having a hole therein, a lateral rib of the plurality of lateral ribs having a lobe extending therefrom, the lobe on the lateral rib having a hole therein;

the dampener having a plurality of legs and an insert approximate a center of the dampener, each leg having an opening therein toward a distal end of the leg;

a plurality of fasteners, a fastener of the plurality of fasteners going through a hole on a lobe and an opening on a leg;

a first pad of the first plurality of pads covering at least a portion of an inside surface of a front section of the first rim;

a second pad of the first plurality of pads covering at least a portion of an inside surface of a back section of the first rim;

an inner shell having an inner frame, a second plurality of pads, and a grommet;

the inner frame having a second rim, a longitudinal rib connected to the second rim, a lateral rib connected to the second rim, an apex having a hole therein, the longitudinal rib and the lateral rib meeting at the apex, and a plurality of ear lobes;

the second plurality of pads substantially covering inside surfaces of the inner frame;

the grommet passing through the hole in the apex; and a fastener extending through the grommet and into the insert.

2. The helmet harness of claim 1 wherein an ear lobe of the plurality of ear lobes extends downwardly from the second rim.

3. The helmet harness of claim 1 wherein an ear lobe of the plurality of ear lobes comprises at least a pair of arms extending from the second rim and meeting each other at a distance from the second rim.

4. The helmet harness of claim 1 wherein the grommet has a flexibility sufficient to allow the outer frame and the inner frame to yaw with respect to each other.

5. The helmet harness of claim 1 wherein the grommet has a flexibility sufficient to allow the outer frame and the inner frame to pitch with respect to each other.

6. The helmet harness of claim 1 wherein the grommet has a flexibility sufficient to allow the outer frame and the inner frame to roll with respect to each other.

7. The helmet harness of claim 1 wherein the grommet grips the fastener and the inner frame sufficient to prevent the inner frame and the outer frame from unrestricted bouncing or movement with respect to each other.

8. The helmet harness of claim 1 wherein the inner frame is a single piece.

9. The helmet harness of claim 1 wherein the longitudinal rib and the lateral rib of the inner frame cross and connect to form a plurality of holes.

* * * * *